US008251359B2

(12) United States Patent
Suzuki

(10) Patent No.: US 8,251,359 B2
(45) Date of Patent: Aug. 28, 2012

(54) SPINE FORMATION DEVICE, BOOKBINDING SYSTEM, AND PROCESSING METHOD OF BUNDLE OF FOLDED SHEETS USING SAME

(75) Inventor: Nobuyoshi Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/929,918

(22) Filed: Feb. 24, 2011

(65) Prior Publication Data

US 2011/0229287 A1 Sep. 22, 2011

(30) Foreign Application Priority Data

Mar. 16, 2010 (JP) ..... 2010-059568

(51) Int. Cl.
*B31F 1/10* (2006.01)

(52) U.S. Cl. ..... 270/45; 270/58.07

(58) Field of Classification Search ..... 270/32, 270/45, 51, 58.07; 493/406, 407, 442, 454; 412/22

See application file for complete search history.

(56) References Cited

U.S. PATENT DOCUMENTS

| | | | | |
|---|---|---|---|---|
| 7,147,598 | B2 * | 12/2006 | Fujimoto et al. | 493/405 |
| 7,431,274 | B2 * | 10/2008 | Kushida et al. | 270/37 |
| 7,631,858 | B2 * | 12/2009 | Harada | 270/58.07 |
| 7,850,156 | B2 * | 12/2010 | Iguchi et al. | 270/37 |
| 2003/0031532 | A1 * | 2/2003 | Nolte et al. | 412/33 |
| 2005/0179190 | A1 | 8/2005 | Kamiya et al. | |
| 2005/0189689 | A1 | 9/2005 | Kushida et al. | |
| 2010/0148417 | A1 | 6/2010 | Suzuki et al. | |
| 2010/0239393 | A1 * | 9/2010 | Suzuki et al. | 412/33 |
| 2010/0258994 | A1 | 10/2010 | Kikkawa et al. | |
| 2010/0303585 | A1 | 12/2010 | Asami et al. | |
| 2010/0310340 | A1 | 12/2010 | Suzuki et al. | |
| 2011/0064541 | A1 | 3/2011 | Kikkawa et al. | |
| 2011/0103919 | A1 | 5/2011 | Furuhashi et al. | |
| 2011/0103921 | A1 | 5/2011 | Suzuki et al. | |
| 2011/0278782 | A1 * | 11/2011 | Watanabe et al. | 270/1.01 |

FOREIGN PATENT DOCUMENTS

| | | |
|---|---|---|
| JP | 2001-260564 A | 9/2001 |
| JP | 2005-162345 | 6/2005 |

OTHER PUBLICATIONS

European Search Report dated Jul. 12, 2011 issued in corresponding European Application No. 11155831.8.

* cited by examiner

*Primary Examiner* — Leslie A Nicholson, III
(74) *Attorney, Agent, or Firm* — Harness, Dickey & Pierce, P.L.C.

(57) ABSTRACT

A spine formation device includes a sheet conveyer to convey a bundle of folded sheets with a folded portion of the bundle forming a front end of the bundle, a clamping unit disposed downstream from the sheet conveyer in a sheet conveyance direction for squeezing a folded portion of the bundle in a direction of thickness of the bundle, a contact member against which the folded portion of the bundle is pressed, disposed downstream from the clamping unit, an elevation unit to move the contact member vertically, and a controller. The clamping unit includes multiple pressure rollers arranged in a single line along the folded portion of the bundle, a planar clamping member disposed facing the multiple pressure rollers vertically, to press the bundle against the multiple pressure rollers, and a unit to move the pressure rollers and the clamping member close and away from each other.

14 Claims, 20 Drawing Sheets

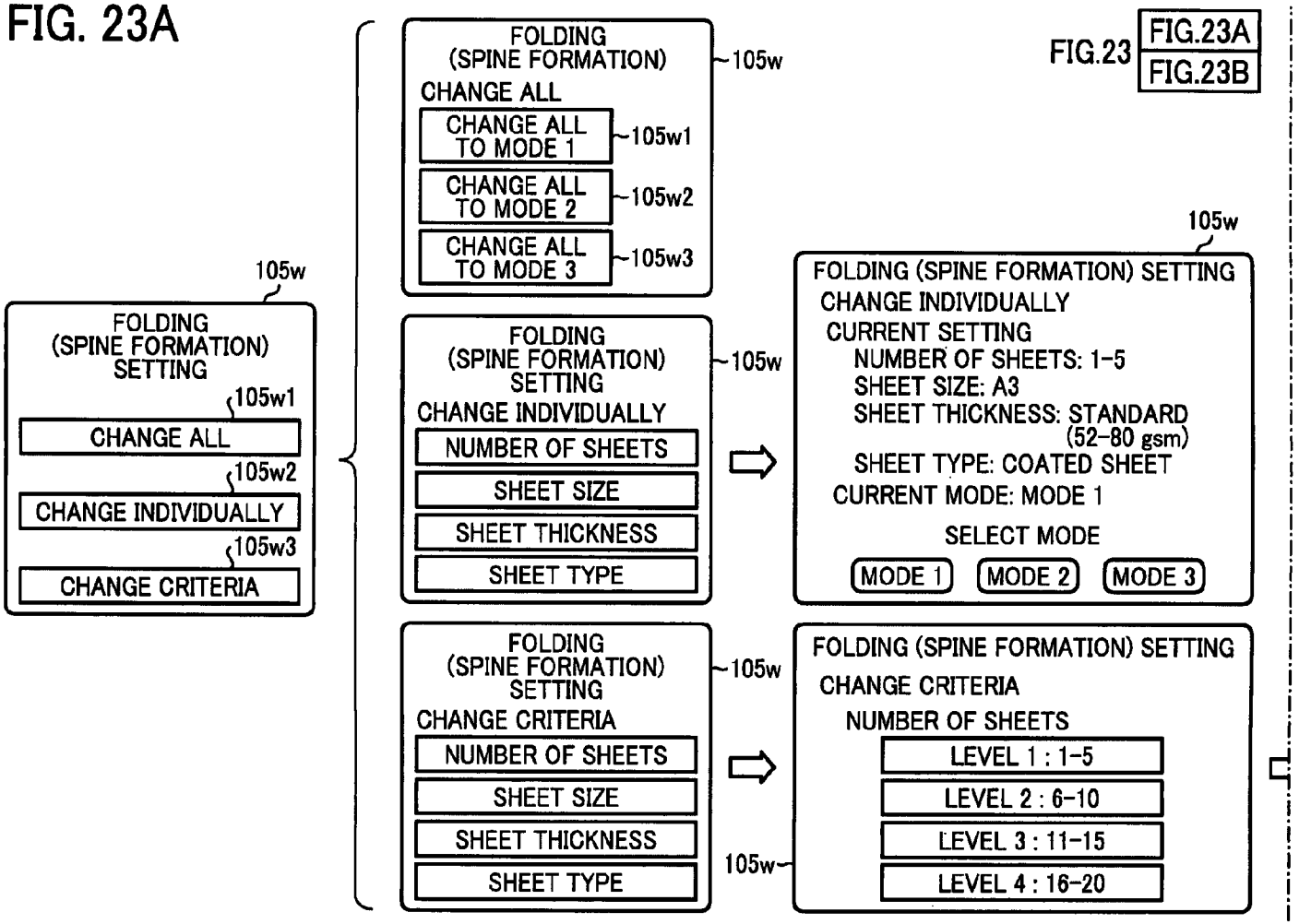
FIG.23
FIG.23A
FIG.23B
105w
FOLDING (SPINE FORMATION) SETTING
CHANGE ALL
105w1
CHANGE ALL TO MODE 1
105w2
CHANGE ALL TO MODE 2
105w3
CHANGE ALL TO MODE 3
FOLDING (SPINE FORMATION) SETTING
CHANGE INDIVIDUALLY
NUMBER OF SHEETS
SHEET SIZE
SHEET THICKNESS
SHEET TYPE
FOLDING (SPINE FORMATION) SETTING
CHANGE INDIVIDUALLY
NUMBER OF SHEETS: 1-5
SHEET SIZE: A3
SHEET THICKNESS: STANDARD (52-80 gsm)
SHEET TYPE: COATED SHEET
CURRENT MODE: MODE 1
SELECT MODE
MODE 1
MODE 2
MODE 3
FOLDING (SPINE FORMATION) SETTING
CHANGE CRITERIA
NUMBER OF SHEETS
SHEET SIZE
SHEET THICKNESS
SHEET TYPE
FOLDING (SPINE FORMATION) SETTING
CHANGE CRITERIA
LEVEL 1 : 1-5
LEVEL 2 : 6-10
LEVEL 3 : 11-15
LEVEL 4 : 16-20
FIG. 23A
FOLDING (SPINE FORMATION) SETTING
CHANGE ALL
CHANGE INDIVIDUALLY
CHANGE CRITERIA

SPINE FORMATION DEVICE, BOOKBINDING SYSTEM, AND PROCESSING METHOD OF BUNDLE OF FOLDED SHEETS USING SAME

CROSS-REFERENCE TO RELATED APPLICATIONS

This patent specification is based on and claims priority from Japanese Patent Application No. 2010-059568, filed on Mar. 16, 2010 in the Japan Patent Office, which is hereby incorporated by reference herein in its entirety.

BACKGROUND OF THE INVENTION

1. Field of the Invention

The present invention generally relates to a spine formation device to form a spine of a bundle of folded sheets, a bookbinding system including the spine formation device and an image forming apparatus, such as a copier, a printer, a facsimile machine, or a multifunction machine capable of at least two of these functions, and a method of processing a bundle of folded sheets.

2. Description of the Background Art

At present, saddle-stitching or saddle-stapling, that is, stitching or stapling a bundle of sheets along its centerline, is widely used as a simple bookbinding method. Typically, the spine of the bundle of sheets (hereinafter "a booklet") produced through saddle-stitching bookbinding tends to bulge as a result of being folded along its centerline. It is preferable to reduce such bulging of the spine of the booklet, that is, to flatten the spine of the booklet, to improve its appearance and to facilitate stacking, storage, and transport of the booklets.

More specifically, when a bundle of sheets is saddle-stitched or saddle-stapled and then folded in two, the folded portion around its spine tends to bulge, degrading the overall appearance of the booklet. In addition, because the bulging spine makes the booklet thicker on the spine side and thinner on the opposite side, when the booklets are piled together with the bulging spines on the same side, the piled booklets tilt more as the number of the booklets increases. Consequently, the booklets might fall over when piled together.

By contrast, when the spine of the booklet is flattened, bulging of the booklet can be reduced, and accordingly multiple booklets can be piled together stably. This flattening is important for ease of storage and transport because it is difficult to stack booklets together if their spines bulge, making it difficult to store or carry them. With this reformation, relatively large number of booklets can be piled together. It is to be noted that the term "spine" used herein means not only the stitched side of the booklet but also portions of the front cover and the back cover continuous with the spine.

In view of the foregoing, for example, the following approaches have been proposed to flatten the spine of the booklet.

For example, in JP-2001-260564-A, the spine of the booklet is flattened using a pressing member configured to clamp simultaneously, from a front cover side and a back cover side of the booklet, an end portion of the booklet adjacent to the spine, and a spine-forming roller configured to roll along the spine longitudinally. The spine-forming roller rolls at least once over the entire length of the spine of the booklet fixed in place by the pressing member while applying to the spine a pressure sufficient to flatten the spine.

Although this approach can flatten the spine of the booklet to a certain extent, it is possible that the sheets might wrinkle and be torn around the spine or folded portion because the spine-forming roller applies localized pressure to the spine continuously. Further, it takes longer to flatten the spine because the spine-forming roller must move over the entire length of the spine of the booklet.

In view of the foregoing, for example, to shape the spine in a reduced time without damaging it, the bulging of the booklet may be squeezed gradually. More specifically, a conveyance unit transports a bundle of folded sheets to a position where the folded leading-edge portion of the bundle is pressed against a contact member and the folded leading-edge portion bulges. Then, the bundle is squeezed in the direction of thickness of the bundle gradually from the upstream side in the direction in which the bundle is transported, thereby localizing the bulging of the booklet to the downstream side. Then, the bundle of sheets is further squeezed with its folded leading-edge pressed against the contact member.

Moreover, at present, efficiency is preferred in flattening the spine of the booklet to reduce the energy required for spine formation. The first approach described above using the spine-forming roller may not be very efficient or energy-saving because the only thing that can be adjusted is the number of times the spine-forming roller rolls on the spine of the booklet.

In view of the foregoing, the inventors of the present invention recognize that there is a need to enhance efficiency in processing the booklet to save energy and time required for the processing as well as to reduce damage to the booklet, which known approaches fail to do.

SUMMARY OF THE INVENTION

In one illustrative embodiment of the present invention, a spine formation device for forming a spine of a bundle of folded sheets includes a sheet conveyer to convey the bundle of folded sheets with a folded portion of the bundle forming a front end portion of the bundle, a clamping unit disposed downstream from the sheet conveyer in a sheet conveyance direction in which the bundle of folded sheets is transported, for squeezing the folded portion of the bundle in a direction of thickness of the bundle, a contact member disposed downstream from the clamping unit in the sheet conveyance direction and including a flat contact surface against which the folded portion of the bundle is pressed, an elevation unit to move the contact member vertically, and a controller operatively connected to the sheet conveyer, the clamping unit, and the elevation unit. The clamping unit includes a pressure roller assembly, a planar clamping member disposed facing the multiple pressure rollers in a direction perpendicular to the sheet conveyance direction, to press the bundle against the multiple pressure rollers, and a unit to move the pressure roller assembly and the planar clamping member close to and away from each other. The pressure roller assembly includes multiple pressure rollers arranged in a single line along the folded portion of the bundle of folded sheets.

Another illustrative embodiment provides a bookbinding system that includes an image forming apparatus to form images on sheets of recording media, a post-processing apparatus to fold a bundle of sheets transported from the image forming apparatus, and the spine formation device described above.

Yet another illustrative embodiment provides a method of processing a bundle of folded sheets in the spine formation device described above. The method includes a step of obtaining a sheet type of the bundle of folded sheets and a reference code of the sheet type, a step of obtaining a sheet thickness of the bundle of folded sheets and a reference code of the sheet thickness, a step of generating a sheet classification code based on the reference code of the sheet type and that of the sheet thickness, a step of selecting a processing determination table, corresponding to the sheet classification code, in which a quantity of sheets is correlated with one of multiple selectable processing modes in which the bundle is processed, a step of obtaining a quantity of the folded sheets, a step of selecting a processing mode of the bundle using the processing determination table and the quantity of the folded sheets, and a step of processing the bundle in the selected processing mode.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
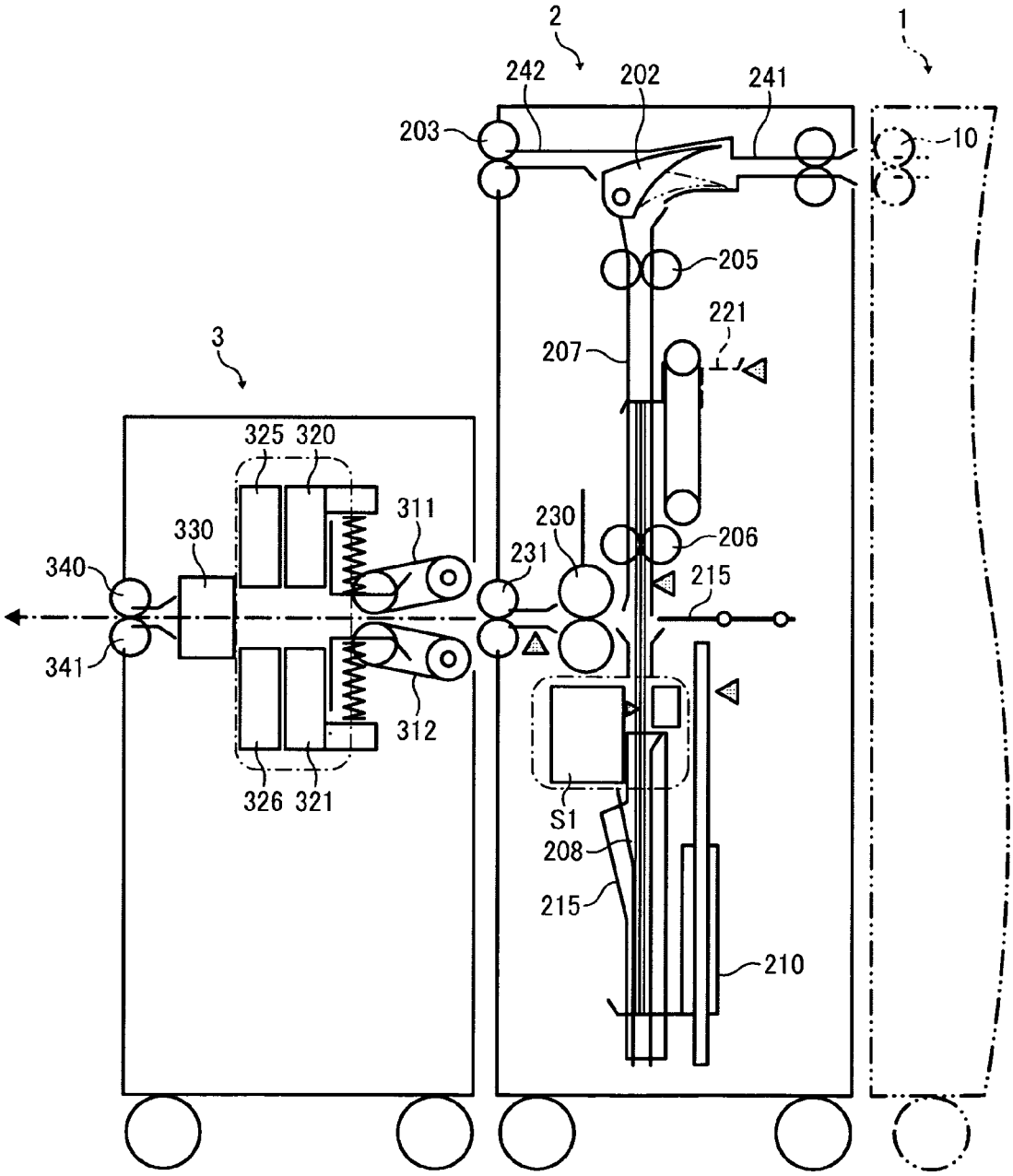
FIG. 1 illustrates a bookbinding system including a post-processing apparatus, a saddle-stapling device, and a spine formation device according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a bookbinding system according to an illustrative embodiment of the present invention is described.

In the embodiments of the present invention, the spine of a bundle of folded sheets and the portions on the front side and the back side adjacent to the spine are pressed and flattened so that the front side and the back side are perpendicular or substantially perpendicular to the spine, forming a square spine portion. At that time, the spine and the adjacent portion are pressed against multiple pressure rollers each having a pressure surface similar in cross section to that of a known pressure roller, and the multiple rollers reciprocally roll on the folded portion of the bundle and press it intermittently. Flattening the spine of the booklets allows a relatively large number of booklets to be piled together with ease and makes it easier to store or transport them.

FIG. 1 illustrates a bookbinding system including a post-processing apparatus 1, a bookbinding device or saddle-stitching device 2, and a spine formation device 3 according to an illustrative embodiment of the present invention.

Figure 20:
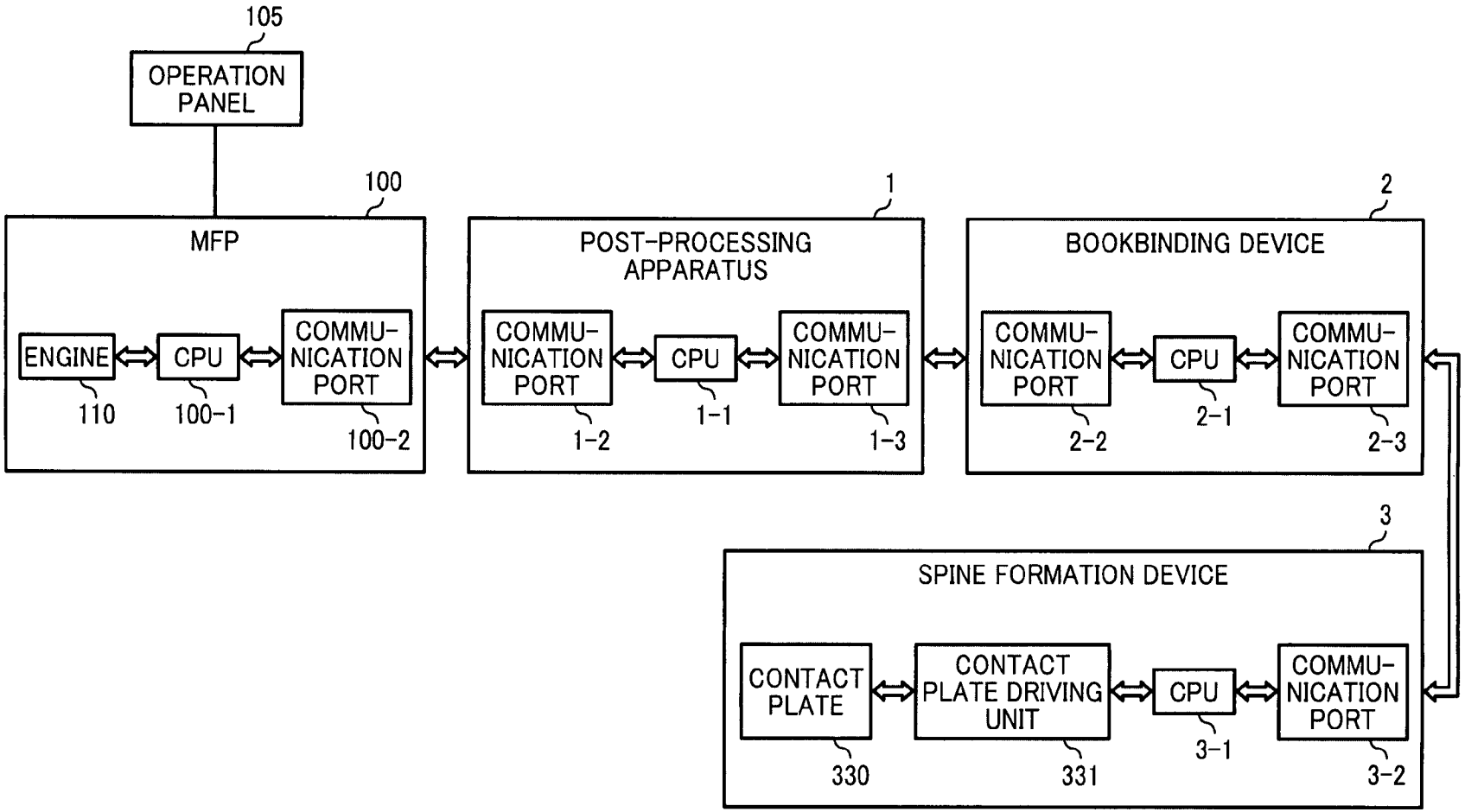
FIG. 20 is a block diagram illustrating a configuration of online control of the bookbinding system.

When connected to an image forming apparatus 100, which is a multifunction peripheral (MFP) in FIG. 20, this system functions as a bookbinding system that can perform image formation through bookbinding inline or online.

In this system, the bookbinding device 2 performs saddle-stitching or saddle-stapling, that is, stitches or staples, along its centerline, a bundle of sheets discharged thereto by a pair of discharge rollers 10 from the post-processing apparatus 1 and then folds the bundle of sheets along the centerline, after which a pair of discharge rollers 231 transports the bundle of folded sheets (booklet) to the spine formation device 3. Then, the spine formation device 3 flattens the folded portion of the booklet and discharges it outside the spine formation device 3. The image forming apparatus (MFP) 100 shown in FIG. 20 may be a copier, a printer, a facsimile machine, or a digital multifunction machine including at least two of those functions that forms images on sheets of recording media based on image data input by users or read by an image reading unit.

The MFP 100 includes a printer engine for forming images and a scanner engine for reading images, together forming an engine 110 shown in FIG. 20. The spine formation device 3 includes transport belts 311 and 312, auxiliary clamping plates 320 and 321, a clamping members 325 and 326 arranged vertically, a contact plate 330, and a pair of discharge rollers 340 and 341 disposed in that order in the sheet conveyance direction. The auxiliary clamping plates 320 and 321 and the clamping members 325 and 326 respectively serve as first clamping members and second clamping members, which together form a clamping unit.

Figure 2:
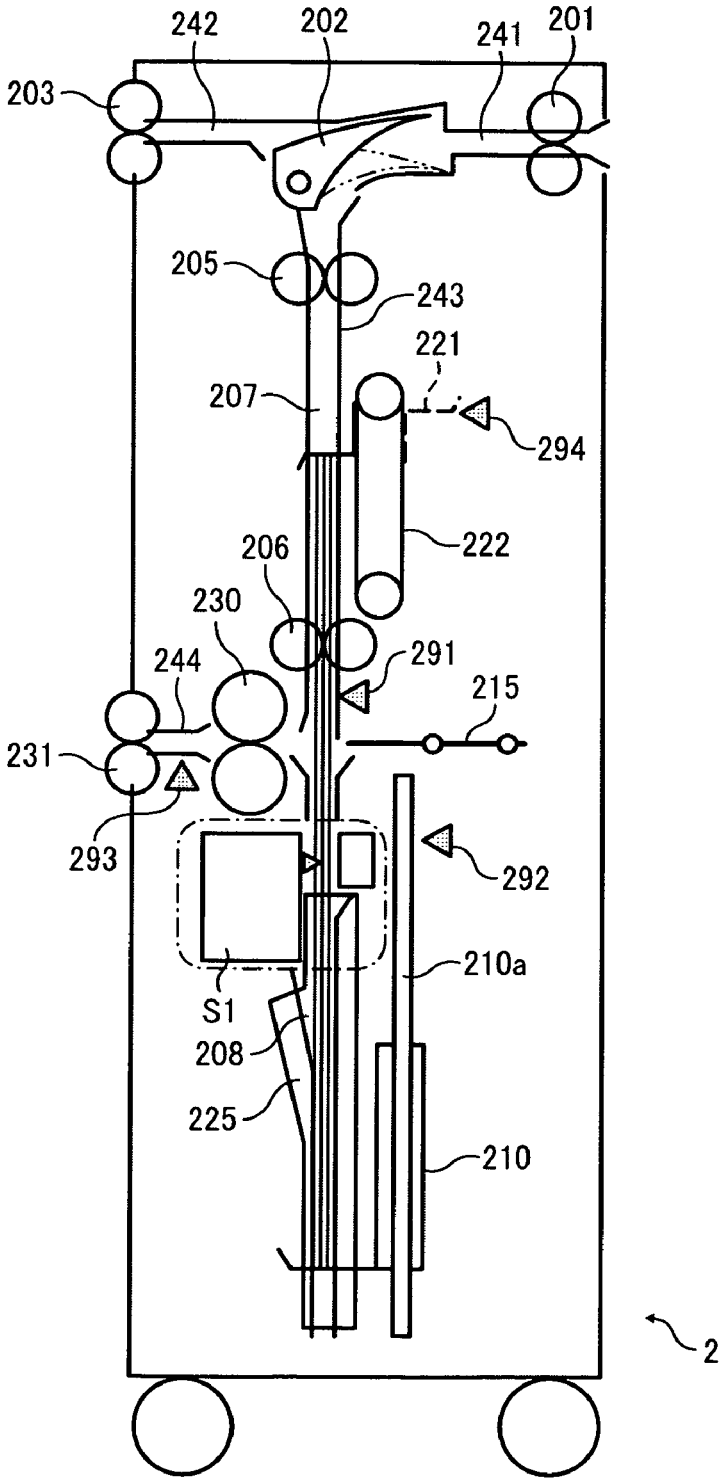
FIG. 2 is a front view illustrating a configuration of the saddle-stapling device shown in FIG. 1.

Referring to FIGS. 1 and 2, a configuration of the bookbinding device 2 is described below.

FIG. 2 illustrates a configuration of the bookbinding device 2.

Referring to FIG. 2, an entrance path 241, a sheet path 242, and a center-folding path 243 are formed in the bookbinding device 2. A pair of entrance rollers 201 provided extreme upstream in the entrance path 241 in the sheet conveyance direction receives a bundle of aligned sheets transported by the discharge rollers 10 of the post-processing apparatus 1. It is to be noted that hereinafter "upstream" and "downstream" refer to those in the sheet conveyance direction unless otherwise specified.

A separation pawl 202 is provided downstream from the entrance rollers 201 in the entrance path 241. The separation pawl 202 extends horizontally in FIG. 2 and switches the sheet conveyance direction between a direction toward the sheet path 242 and that toward the center-folding path 243. The sheet path 242 extends horizontally from the entrance path 241 and guides the bundle of sheets to a downstream device or a discharge tray, not shown, and a pair of upper discharge rollers 203 discharges the bundle of sheets from the sheet path 242. The center-folding path 243 extends vertically in FIGS. 1 and 2 from the separation pawl 202, and the bundle of sheets is transported along the folding path 243 when at least one of stapling and folding is performed.

Along the center-folding path 243, an upper sheet guide 207 and a lower sheet guide 208 to guide the bundle of sheets are provided above and beneath a folding plate 215, respectively, and the folding plate 215 is used to fold the bundle of sheets along its centerline. A pair of upper transport rollers 205, a trailing-edge alignment pawl 221, and a pair of lower transport rollers 206 are provided along the upper sheet guide 207 in that order from the top in FIG. 2. The trailing-edge alignment pawl 221 is attached to a pawl driving belt 222 driven by a driving motor, not shown, and extends perpendicularly to a surface of the driving belt 222. As the pawl driving belt 222 rotates opposite directions alternately, the trailing-edge alignment pawl 221 pushes a trailing-edge of the bundle of sheets toward a movable fence 210 disposed in a lower portion in FIG. 2, thus aligning the bundle of sheets. Additionally, as indicated by broken lines shown in FIG. 2, the trailing-edge pawl 221 moves away from the upper sheet guide 207 provided along the center-folding path 243 when the bundle of sheets enters the center-folding path 243 and when the bundle of sheets ascends to be folded. In FIG. 2, reference numeral 294 represents a pawl home position (HP) detector that detects the trailing-edge alignment pawl 221 at a home position indicated by the broken lines shown in FIG. 2. The trailing-edge alignment pawl 221 is controlled with reference to the home position.

A saddle stapler S1, a pair of jogger fences 225, and the movable fence 210 are provided along the lower sheet guide 208 in that order from the top in FIG. 2. The lower sheet guide 208 receives the bundle of sheets guided by the upper sheet guide 207, and the pair of jogger fences 225 extends in a sheet width direction perpendicular to the sheet conveyance direction. The movable fence 210 positioned beneath the lower sheet guide 208 moves vertically, and a leading edge of the bundle of sheets contacts the movable fence 210.

The saddle stapler S1 staples the bundle of sheets along its centerline. While supporting the leading edge of the bundle of sheets, the movable fence 210 moves vertically, thus positioning a center portion of the bundle of sheets at a position facing the saddle stapler S1, where saddle stapling is performed. The movable fence 210 is supported by a fence driving mechanism 210*a* and can move from the position of a fence HP detector 292 disposed above the stapler S1 to a bottom position in the post-processing apparatus 2 in FIG. 2. A movable range of the movable fence 210 that contacts the leading edge of the bundle of sheets is set so that strokes of the movable fence 210 can align sheets of any size processed by the bookbinding device 2. It is to be noted that, for example, a rack-and-pinion may be used as the fence driving mechanism 210*a*.

The folding plate 215, a pair of folding rollers 230, and a discharge path 244, and the pair of lower discharge rollers 231 are provided horizontally between the upper sheet guide 207 and the lower sheet guide 208, that is, in a center portion of the center-folding path 243 in FIG. 2. The folding plate 215 can move reciprocally back and forth horizontally in FIG. 2 in the folding operation, and the folding plate 215 is aligned with a position where the folding rollers 230 press against each other (hereinafter "nip") in that direction. The discharge path 244 is positioned also on an extension line from the line connecting them. The lower discharge rollers 231 are disposed extreme downstream in the discharge path 244 and discharge the bundle of folded sheets to a subsequent stage.

Additionally, a sheet detector 291 provided on a lower side of the upper sheet guide 207 in FIG. 2 detects the leading edge of the bundle of sheets that passes a position facing the folding plate 215*a* (hereinafter "folding position") in the center-folding path 243. Further, a folded portion detector 293 provided along the discharge path 224 detects the folded leading-edge portion (hereinafter simply "folded portion") of the bundle of folded sheets, thereby recognizes the passage of the bundle of folded sheets.

Saddle-stapling and center-holding performed by the bookbinding device 2 shown in FIG. 2 are described briefly below with reference to FIGS. 3 through 7. When a user selects saddle-stapling and center-folding via an operation panel 105 (shown in FIG. 20) of the image forming apparatus 100 (shown in FIG. 20), the separation pawl 202 pivots counterclockwise in FIG. 2, thereby guiding the bundle of sheets to be stapled and folded to the center-folding path 243. The separation pawl 201 is driven by a solenoid, not shown. Alternatively, the separation pawl 201 may be driven by a motor.

Figure 3:
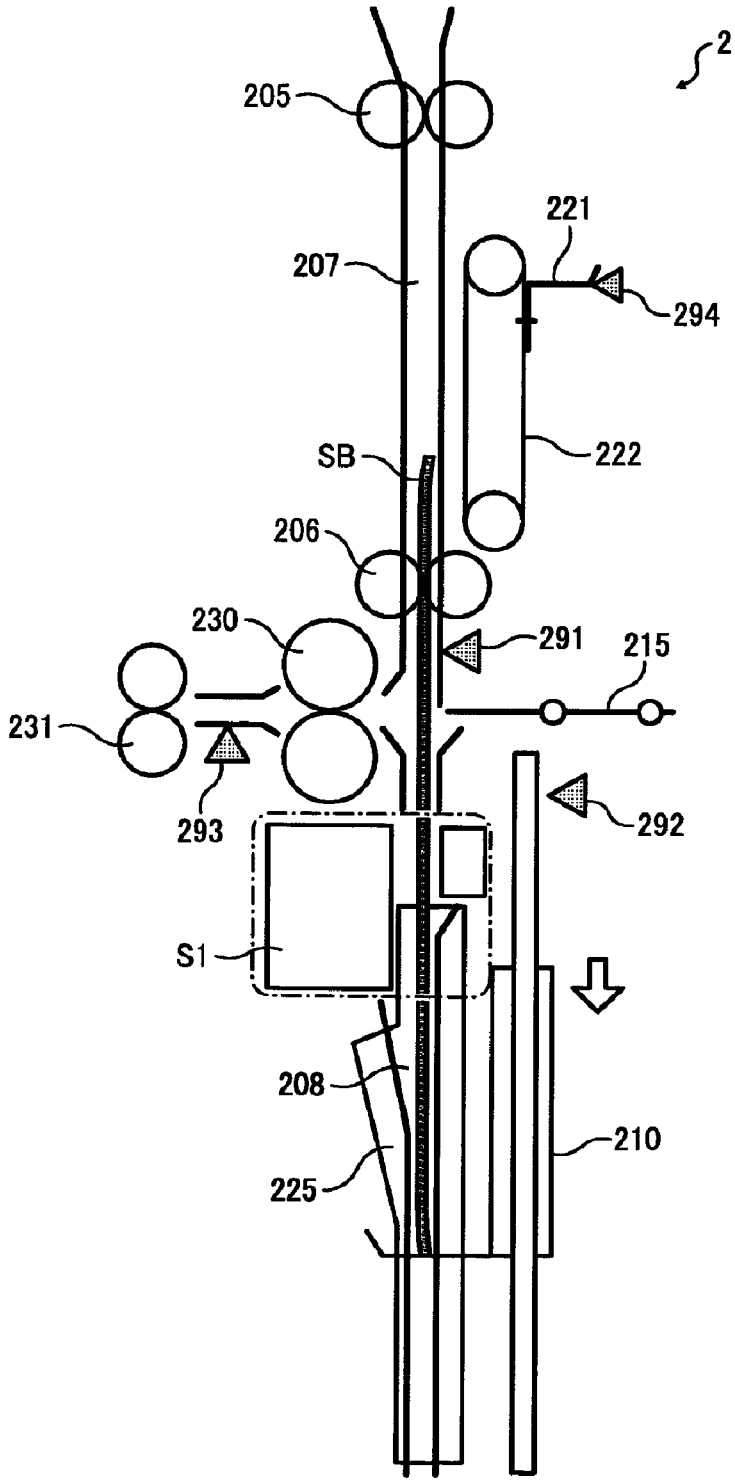
FIG. 3 illustrates the saddle-stapling device in which a bundle of sheets is transported.

A bundle of sheets SB transported to the center-folding path 243 is transported by pair of entrance rollers 201 and the pair of upper transport rollers 205 downward in the center-folding path 243 in FIG. 3. After the sheet detector 291 detects the passage of the bundle of sheets SB, the lower transport rollers 206 transport the bundle of sheets SB until the leading edge of the bundle of sheets SB contacts the movable fence 210 as shown in FIG. 3. At that time, the movable fence 210 is at a standby position varied in the vertical direction shown in FIG. 3 according to size data of the bundle of sheets SB, which in this operation is size data in the sheet conveyance direction, transmitted from the image forming apparatus 100 shown in FIG. 20. Simultaneously, the lower transport rollers 206 clamp the bundle of sheets SB therebetween, and the trailing-edge alignment pawl 221 is at the home position.

Figure 4:
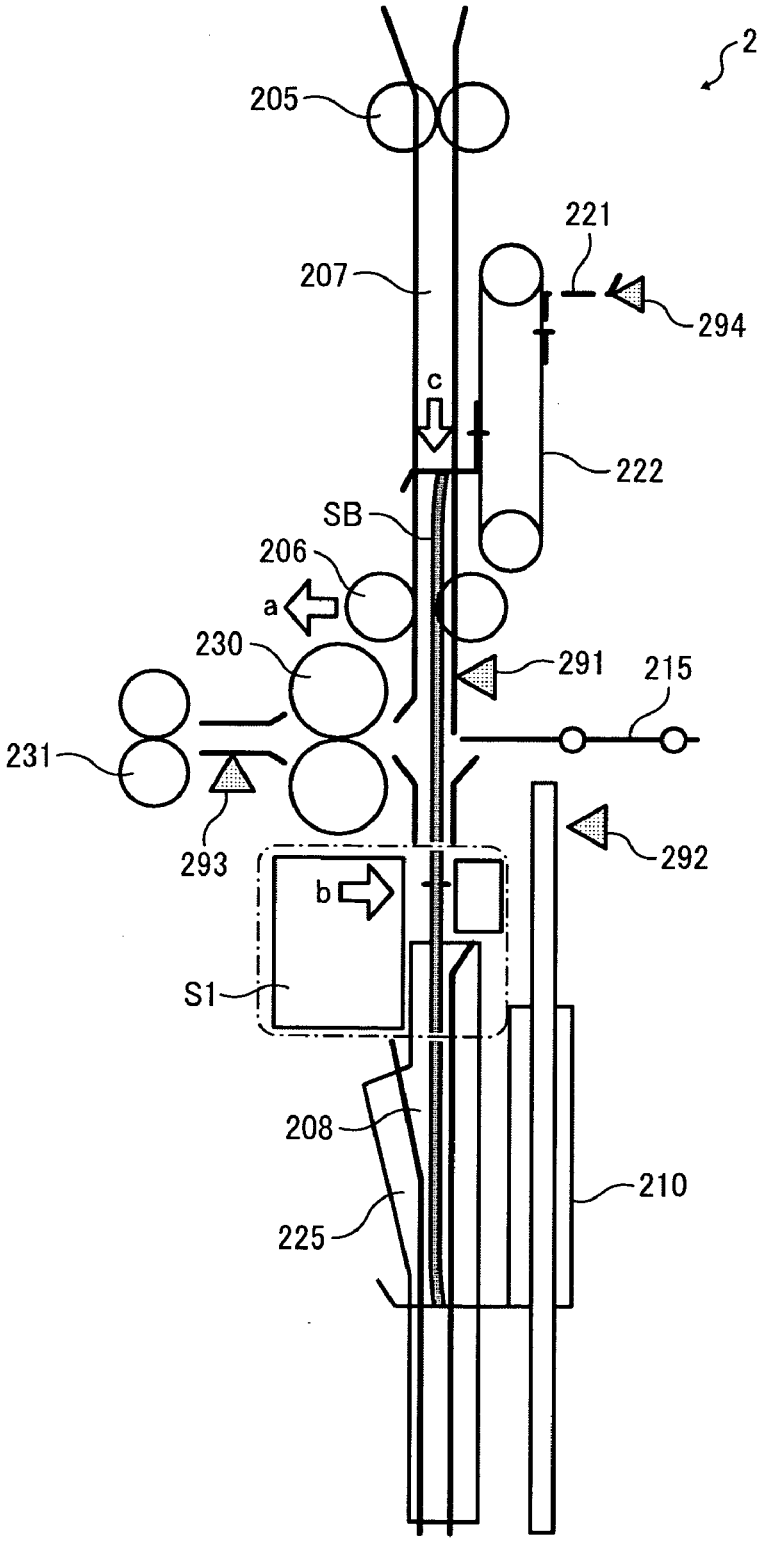
FIG. 4 illustrates the saddle-stapling device in which the bundle of sheets is stapled along the centerline.

When the pair of lower transport rollers 206 is moved away from each other as indicated by arrow a shown in FIG. 4, releasing the trailing edge of the bundle of sheets SB whose leading edge is in contact with the movable fence 210, the trailing-edge alignment pawl 221 is driven to push the trailing edge of the bundle of sheets SB, thus completing alignment of the bundle of sheets SB in the sheet conveyance direction as indicated by arrow c shown in FIG. 4.

Subsequently, the bundle of sheets SB is aligned in the sheet width direction perpendicular to the sheet conveyance direction by the pair of jogger fences 225, and thus alignment of the bundle of sheets SB in both the sheet width direction and the sheet conveyance direction is completed. At that time, the amounts by which the trailing-edge alignment pawl 221 and the pair of jogger fences 225 push the bundle of sheets SB to align it are set to optimum values according to the size data (sheet size data) of the bundle of sheets including the quantity of sheets and the thickness of the bundle. It is to be noted that, in addition to the sheet size data including the quantity of sheets and the thickness of the bundle, special sheet classification that indicates that the bundle is formed with special type of sheets is used in setting mode described later.

It is to be noted that, when the bundle of sheets SB is relatively thick, it occupies a larger area in the center-folding path 243 with the remaining space therein reduced, and accordingly a single alignment operation is often insufficient to align it. Therefore, the number of alignment operations is increased in that case. Thus, the bundle of sheets SB can be aligned fully. Additionally, as the quantity of sheets increases, it takes longer to stack multiple sheets one on another upstream from the post-processing apparatus 2, and accordingly it takes longer before the post-processing apparatus 2 receives a subsequent bundle of sheets. Consequently, the increase in the number of alignment operations does not cause a loss time in the sheet processing system, and thus efficient and reliable alignment can be attained. Therefore, the number of alignment operations may be adjusted according to the time required for the upstream processing.

It is to be noted that the standby position of the movable fence 210 is typically positioned facing the saddle-stapling position of the bundle of sheets SB or the stapling position of the saddle stapler S1. When aligned at that position, the bundle of sheets SB can be stapled at that position without moving the movable fence 210 to the saddle-stapling position of bundle of sheets SB. Therefore, at that standby position, a stitcher, not shown, of the saddle stapler S1 is driven in a direction indicated by arrow b shown in FIG. 4, and thus the bundle of sheets SB is stapled between the stitcher and a clincher, not shown, of the saddle stapler S1.

It is to be noted that the positions of the movable fence 210 and the trailing-edge alignment pawl 221 are controlled with pulses of the fence HP detector 292 and the pawl HP detector 294, respectively. Positioning of the movable fence 210 and the trailing-edge alignment pawl 221 is performed by a central processing unit (CPU) 2-1 (shown in FIG. 20) of the bookbinding device 2.

Figure 5:
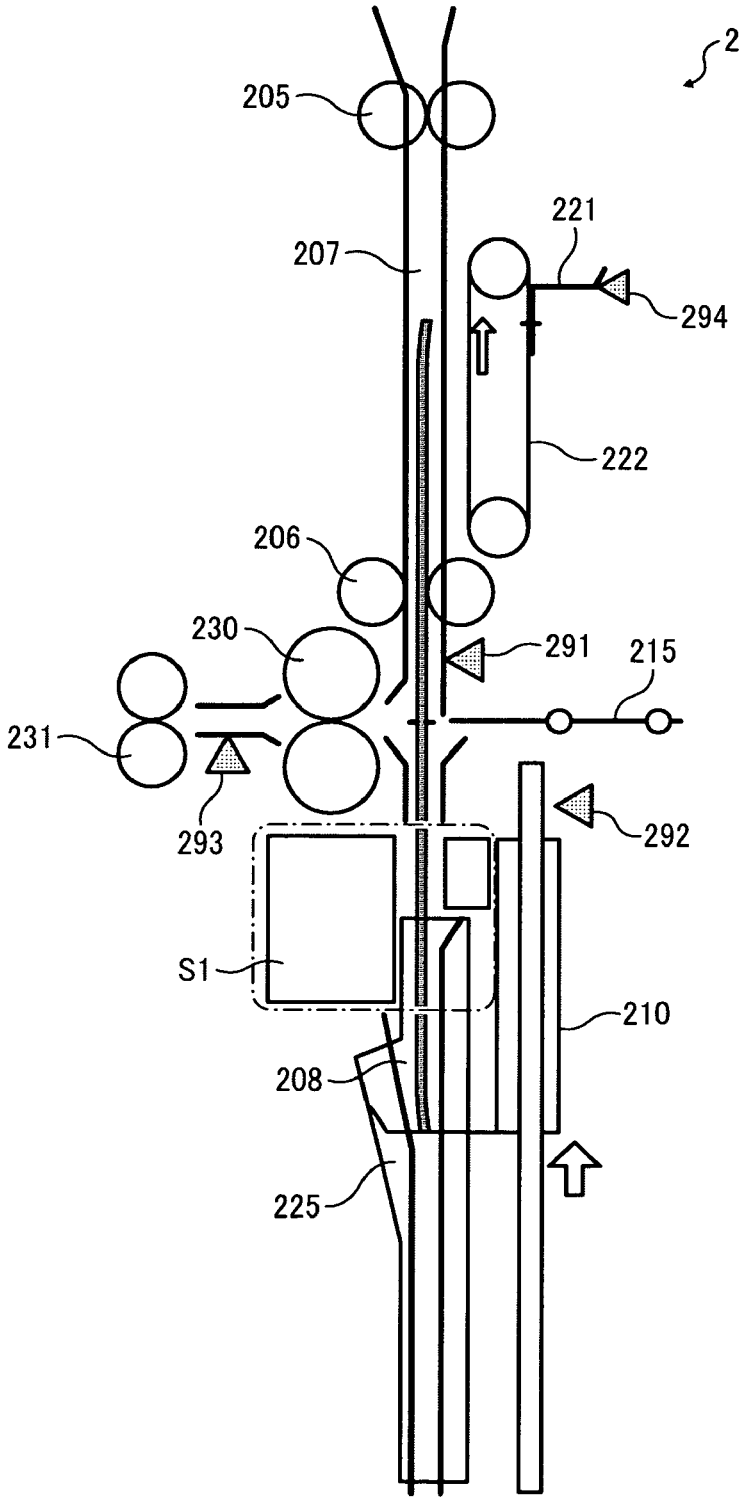
FIG. 5 illustrates the saddle-stapling device in which the bundle of sheets is set at a center-folding position.

After stapled along the centerline in the state shown in FIG. 4, the bundle of sheets SB is lifted to a position where the saddle-stapling position thereof faces the folding plate 215 as the movable fence 210 moves upward as shown in FIG. 5 while the pair of lower transport rollers 206 does not press against the bundle of sheets SB. This position is adjusted with reference to the position detected by the fence HP detector 292.

Figure 6:
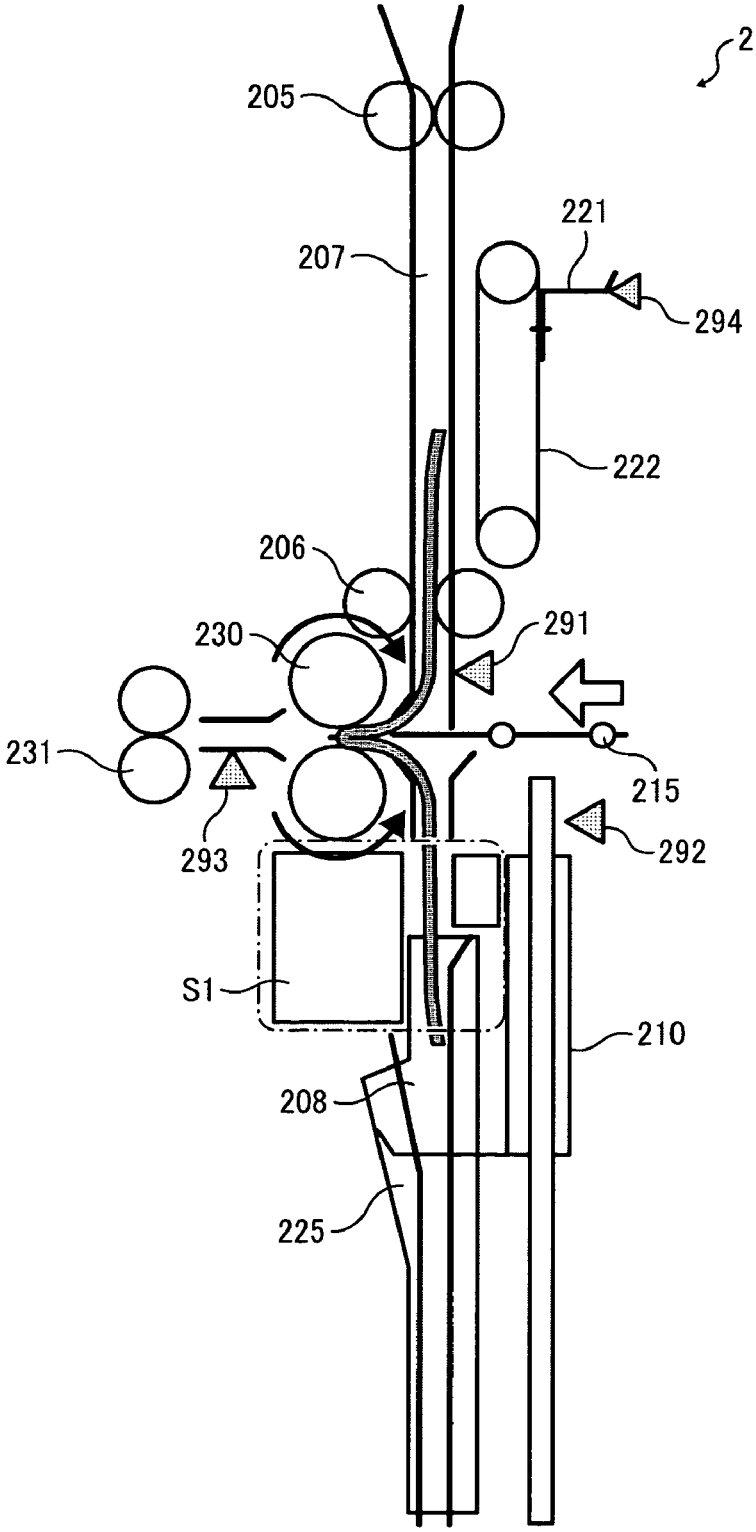
FIG. 6 illustrates the saddle-stapling device in which the bundle of sheets is being folded in two.
Figure 7:
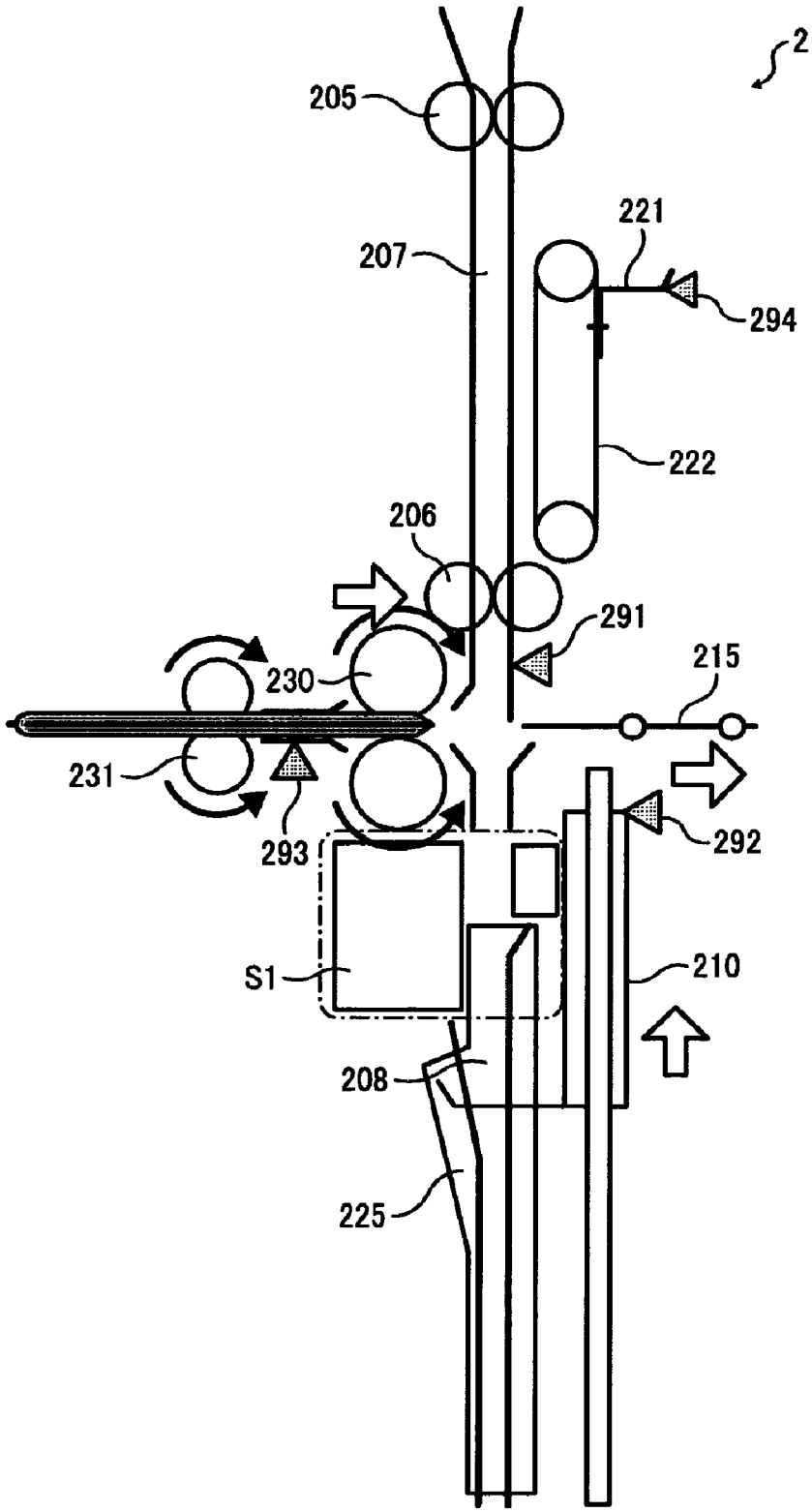
FIG. 7 illustrates the saddle-stapling device from which the bundle of folded sheets is discharged.

When the bundle of sheets SB is set at the position shown in FIG. 5, the folding plate 215 approaches the nip between the pair of folding rollers 230 as shown in FIG. 6 and pushes toward the nip the bundle of sheets SB in a portion around the staples binding the bundle in a direction perpendicular or substantially perpendicular to a surface of the bundle of sheets SB. Thus, the bundle of sheets SB pushed by the folding plate 215 is folded in two and clamped between the pair of folding roller 230 being rotating. While squeezing the bundle of sheets SB caught in the nip, the pair of folding roller 230 transports the bundle of sheets SB. Thus, while squeezed and transported by the folding rollers 230, the bundle of sheets SB is center-folded as a booklet SB. FIG. 6 illustrates a state in which a folded leading edge of the booklet SB is squeezed in the nip between the folding rollers 230.

After folded in two as shown in FIG. 6, the booklet SB is transported by the folding rollers 230 downstream and then discharged by the discharged rollers 231 to a subsequent stage. When the folded portion detector 293 detects a trailing edge portion of the booklet SB, both the folding plate 215 and the movable fence 210 return to the respective home positions. Then, the lower transport rollers 206 move to press against each other as a preparation for receiving a subsequent bundle of sheets. Further, if the number and the size of sheets forming the subsequent bundle are similar to those of the previous bundle of sheets, the movable fence 210 can wait again at the position shown in FIG. 3. The above-described control is performed also by the CPU 2-1 of a control circuit shown in FIG. 20.

Figure 8:
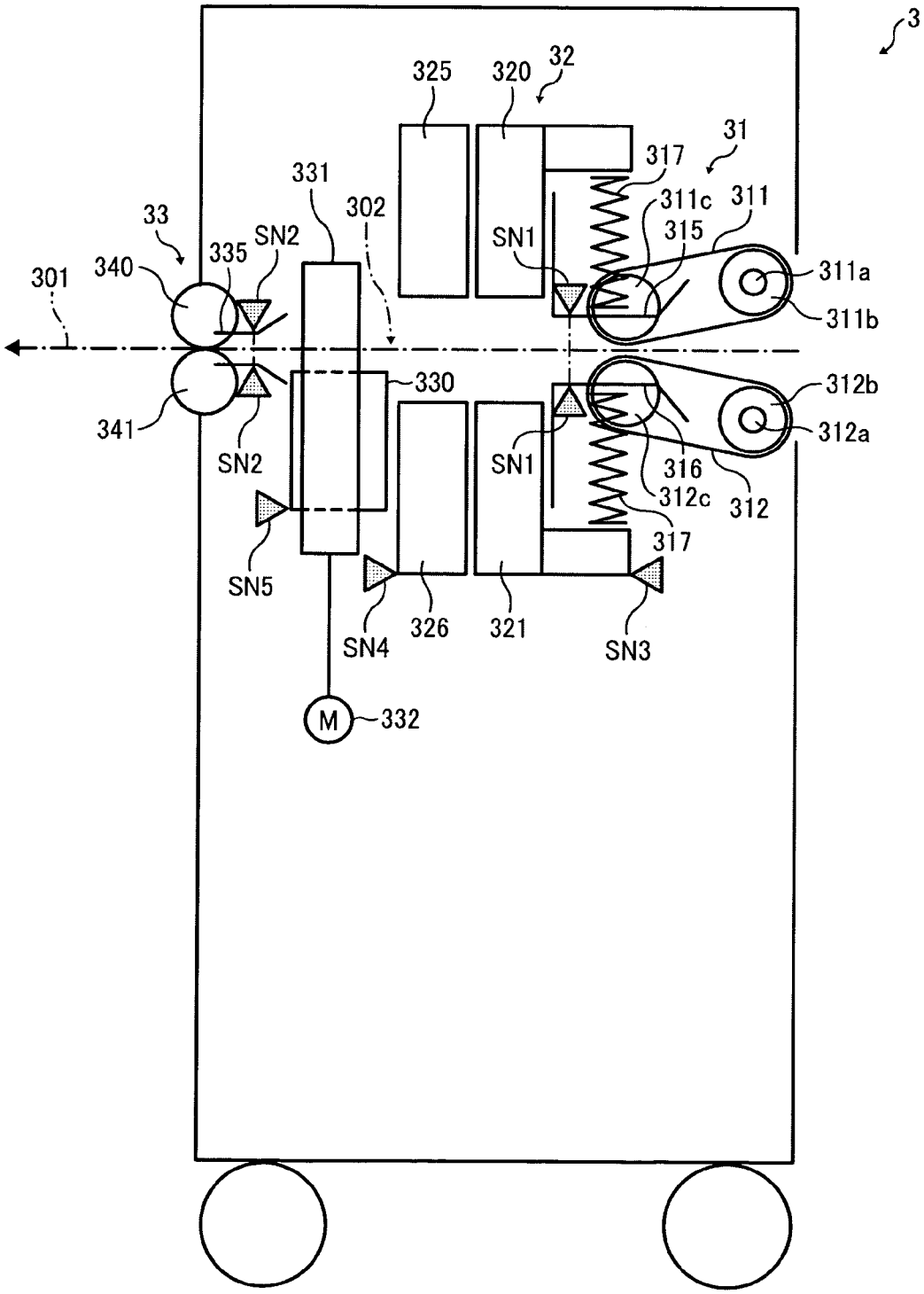
FIG. 8 is a front view illustrating a configuration of the spine formation device shown in FIG. 1.

FIG. 8 is a front view illustrating a configuration of the spine formation device 3 shown in FIG. 1. Referring to FIG. 8, the spine formation device 3 includes a conveyance unit 31 serving as a sheet conveyer, an auxiliary clamping unit 32, a clamping unit (i.e., clamping member 325 and 326), a contact member, and a discharge unit 33 disposed in that order in the sheet conveyance direction. It is to be noted that, in this specification, the booklet means the bundle of folded sheets that is stapled along its centerline and is different from unbound sheets S.

The conveyance unit 31 includes the vertically-arranged transport belts 311 and 312, and the auxiliary clamping unit 32 includes vertically-arranged guide plates 315 and 316 and the auxiliary clamping plates 320 and 321. The contact plate 330 serves as the contact member, and the discharge unit 33 includes the discharge guide plate 335 and the pair of discharge rollers 340 and 341. It is to be noted that, the lengths of the above-described components are greater than the width of the booklet SB in a direction perpendicular to the surface of paper on which FIG. 8 is drawn. The auxiliary clamping unit 32, the clamping member 325 and 326, and the contact plate 330 together form a spine formation unit.

Figure 9A:
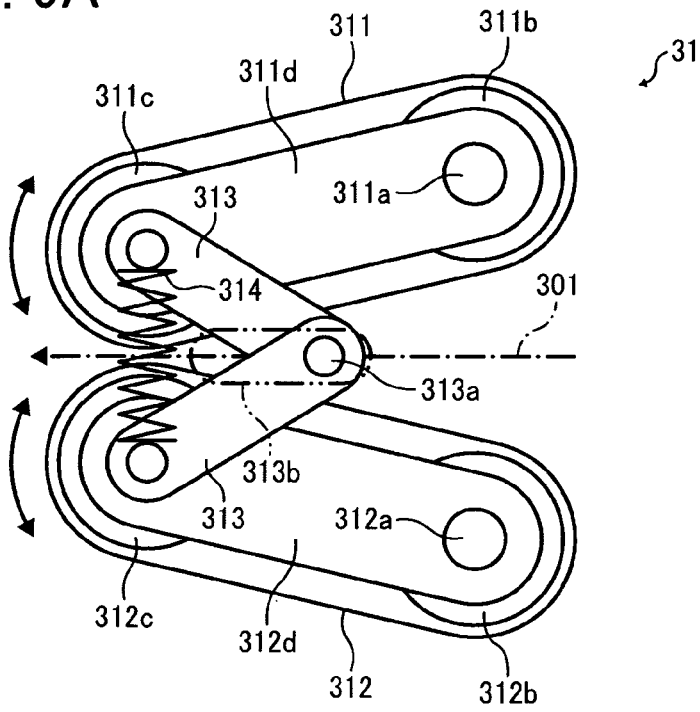
FIG. 9A illustrates an initial state of a transport unit of the spine formation device shown in FIG. 8 to transport a bundle of folded sheets.
Figure 9B:
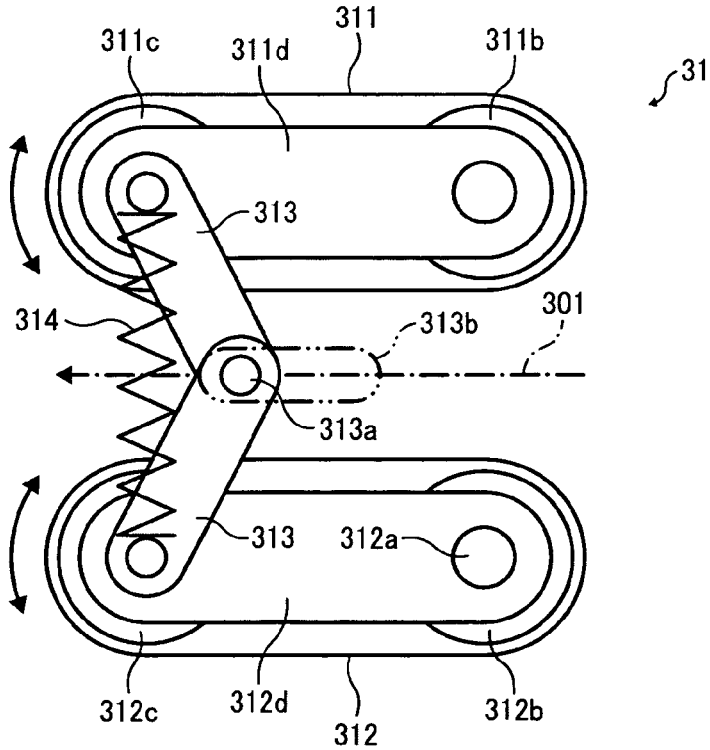
FIG. 9B illustrates a state of the transport unit shown in FIG. 9A in which the bundle of folded sheets is transported.

The transport belts 311 and 312 are disposed on both sides of (in FIG. 8, above and beneath) a transport centerline 301 of a transport path 302, aligned with the line extended from the line connecting the folding plate 215, the nip between the folding rollers 230, and the nip between the discharge rollers 231. The upper transport belt 311 and the lower transport belt 312 are respectively stretched around driving pulleys 311*b* and 312*b* supported by swing shafts 311*a* and 312*a* and driven pulleys 311*c* and 312*c* that are disposed downstream from the driving pulleys 311*b* and 312*b* and face each other across the transport centerline 301. A driving motor, not shown, drives the transport belts 311 and 312. The swing shafts 311*a* and 312*a* respectively support the transport belts 311 and 312 swingably so that the gap between the driven pulleys 311*c* and 312*c* is adjusted corresponding to the thickness of the bundle of sheets. FIGS. 9A and 9B illustrate an initial state of the spine formation device 3 and a state in which the booklet SB is transported therein, respectively.

As shown in FIGS. 9A and 9B, the driving pulleys 311*b* and 312*b* are connected to the driven pulleys 311*c* and 312*c* with support plates 311*d* and 312*d*, respectively, and the transport belts 311 and 312 are respectively stretched around the driving pulleys 311*b* and 312*b* and the driven pulleys 311*c* and 312*c*. With this configuration, the transport belts 311 and 312 are driven by the driving pulleys 311*b* and 312*b*, respectively.

By contrast, rotary shafts of the driven pulleys 311*c* and 312*c* are connected by a link 313 formed with two members connected movably with a connection shaft 313*a*, and a pressure spring 314 biases the driven pulleys 311*c* and 312*c* to approach each other. The connection shaft 313*a* engages a slot 313*b* extending in the sheet conveyance direction, formed in a housing of the spine formation device 3 and can move along the slot 313*b*. With this configuration, as the two members forming the link 313 attached to the driven pulleys 311*c* and 312*c* move, the connection shaft 313*a* moves along the slot 313*b*, thus changing the distance between the driven pulleys 311*c* and 312*c* corresponding to the thickness of the booklet SB while maintaining a predetermined or given pressure in a nip where the transport belts 311 and 312 press against each other.

Additionally, a rack-and-pinion mechanism can be used to move the connection shaft 313*a* along the slot 313*b*, and the position of the connection shaft 313*a* can be set by controlling a motor driving the pinion. With this configuration, when the booklet SB is relatively thick, the distance between the driven pulleys 311*c* and 312*c* (hereinafter "transport gap E can be increased to receive the booklet SB, thus reducing the pressure applied to the folded portion (folded leading-edge portion) of the booklet SB by the transport belts 311 and 312 on the side of the driven pulleys 311*c* and 312*c*. It is to be noted that, when power supply to the driving motor is stopped after the folded portion of the booklet SB is clamped between the transport belts 311 and 312, the driven pulleys 311*c* and 312*c* can transport the booklet SB clamped therebetween with only the elastic bias force of the pressure spring 314.

Figure 10A:
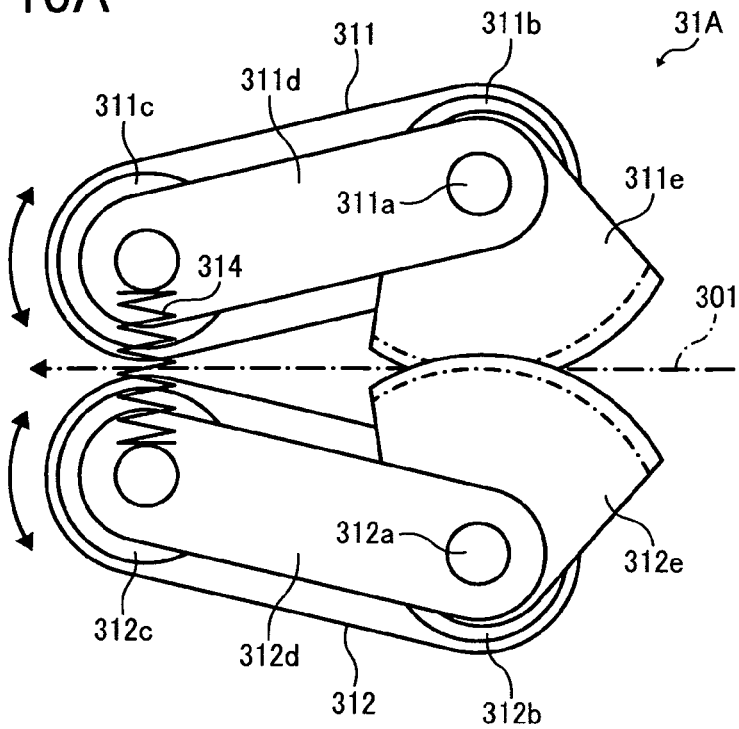
FIGS. 10A and 10B are diagrams of another configuration of the transport unit illustrating an initial state and a state in which the bundle of folded sheets is transported, respectively.
Figure 10B:
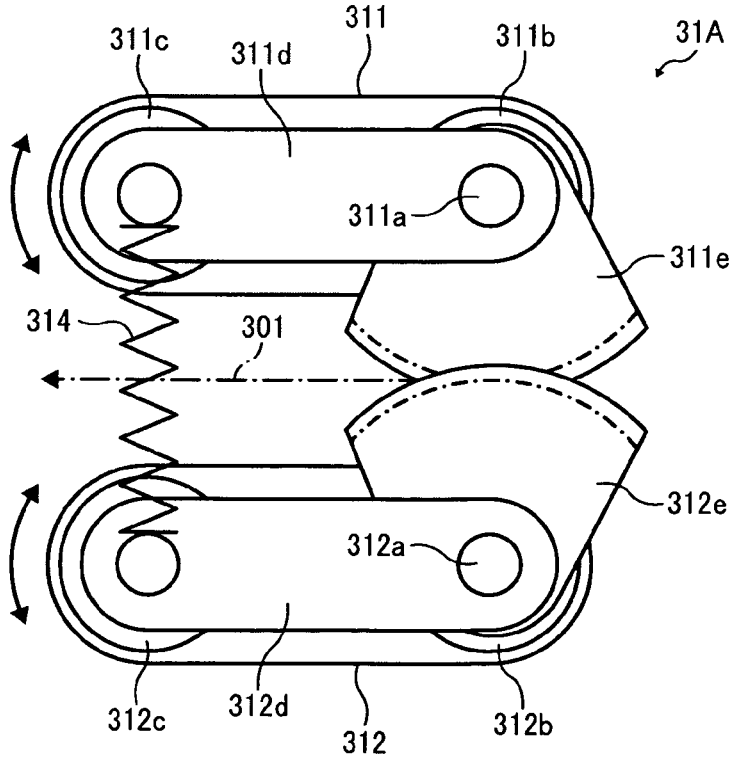

FIGS. 10A and 10B illustrate a conveyance unit 31A in which, instead of using the link 314, the swing shafts 311*a* and 312*a* engage sector gears 311*e* and 312*e*, respectively, and the sector gears 311*e* and 312*e* engaging each other cause the driven pulleys 311*c* and 312*c* to move away from the transport centerline 301 symmetrically. FIGS. 10A and 10B illustrate an initial state of the conveyance unit 31A and a state in which the booklet SB is transported therein, respectively. Also in this configuration, the size of the transport gap to receive the booklet SB can be adjusted by driving one of the sector gears 311*e* and 312*e* with a driving motor including a decelerator similarly to the configuration shown in FIGS. 9A and 9B.

As shown in FIG. 8, the guide plates 315 and 316 are arranged symmetrically on both sides of the transport centerline 301, adjacent to the driven pulleys 311*c* and 312*c*, respectively. The guide plates 315 and 316 respectively include flat surfaces facing the transport path 302, extending from the transport nip to a position adjacent to the auxiliary clamping plates 320 and 321, and the flat surfaces serve as transport surfaces. The upper guide plate 315 and the lower guide plate 316 are attached to the upper auxiliary clamping plate 320 and the lower auxiliary clamping plate 321 with pressure springs 317, respectively, biased to the transport centerline 301 elastically by the respective pressure springs 317, and can move vertically. Further, the auxiliary clamping plates 320 and 321 are held by a housing of the spine formation device 3 movably in the vertical direction in FIG. 8. It is to be noted that, alternatively, the guide plates 315 and 316 may be omitted, and the booklet SB may be guided by only surfaces of the auxiliary clamping plates 320 and 321 facing the booklet SB.

The vertically-arranged auxiliary clamping plates 320 and 321 of the auxiliary clamping unit 32 approach and move away from each other symmetrically relative to the transport centerline 301 similarly to the transport belts 311 and 312. A driving mechanism, not shown, provided in the auxiliary clamping unit 32 to cause this movement can use the link mechanism used in the conveyance unit 31, the connection mechanism using the rack and the sector gear shown FIGS. 10A and 10B, or a screw shaft 320 shown in FIG. 12.

A reference position used in detecting a displacement of the auxiliary clamping plates 320 and 321 can be set with the output from the auxiliary clamping plate HP detector SN3. Because the vertically-arranged auxiliary clamping plates 320 and 321 and the driving unit, not shown, are connected with a spring similar to the pressure spring 314 in the conveyance unit 31, or the like, when the booklet SB is clamped by the auxiliary clamping plates 320 and 321, damage to the driving mechanism caused by overload can be prevented. The surfaces of the auxiliary clamping plates 320 and 321 (e.g., pressure clamping surfaces) that clamp the booklet SB are flat surfaces in parallel to the transport centerline 301.

Figure 12:
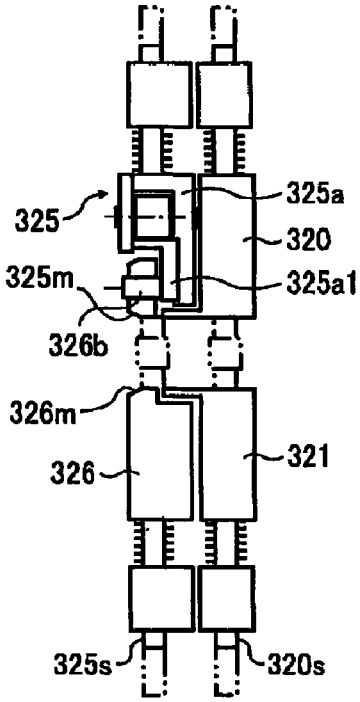
FIG. 12 is a side view of the clamping unit as viewed from the right in FIG. 11.
Figure 13:
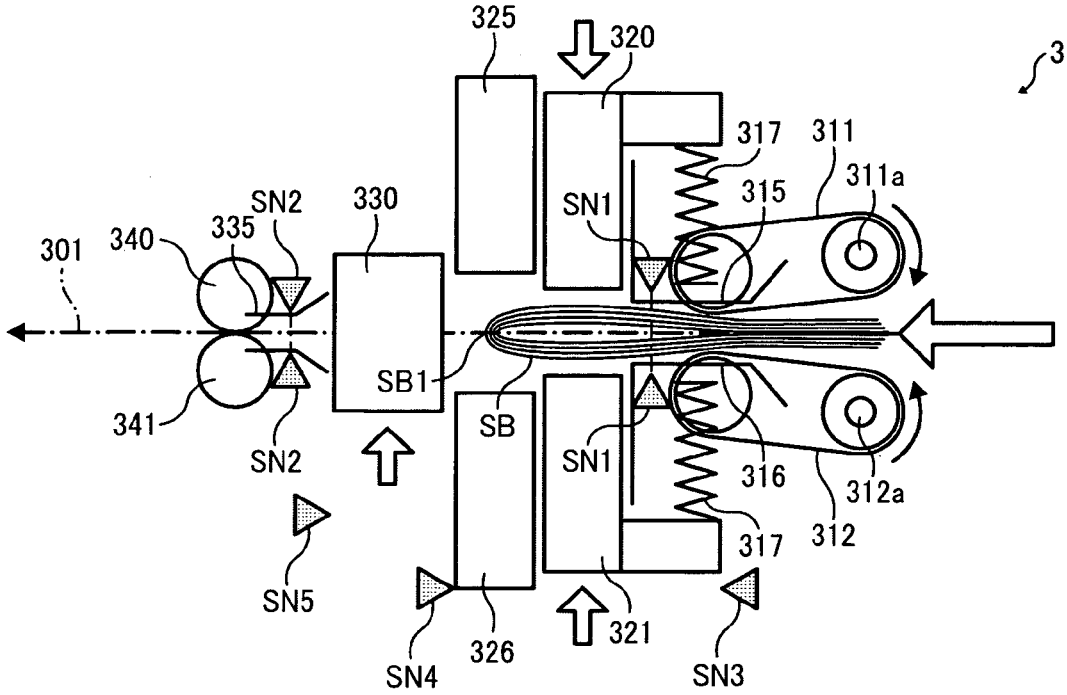
FIG. 13 illustrates a state of the spine formation device in which the bundle of folded sheets is transported therein.

The vertically-arranged clamping members 325 and 326 shown in further detail in FIGS. 13 and 12 serves as the first clamping members and approach and move away from each other symmetrically with respect to the transport centerline 301 similarly to the transport belts 311 and 312. A driving mechanism to cause the clamping members 325 and 326 this movement can use the link mechanism used in the conveyance unit 31 or the connection mechanism using the rack and the sector gear shown FIGS. 10A and 10B. One of the vertically-arranged clamping members 325 and 326, which in the present embodiment is the upper clamping member 325, includes multiple rollers 325*b*. The multiple rollers 325*b* together form a pressure roller assembly. A reference position used in detecting a displacement of the clamping members 325 and 326 can be set with the output from the clamping plate HP detector SN4. Other than the description above, the clamping members 325 and 326 have configurations similar the auxiliary clamping plates 320 and 321 and operate similarly thereto, and thus descriptions thereof are omitted. It is to be noted that a driving source such as a driving motor is requisite in the auxiliary clamping unit 32 and the clamping unit although it is not requisite in the conveyance unit 31, and the driving source enables the movement between a position to clamp the booklet and a standby position away form the booklet. The surfaces of the clamping members 325 and 326 (e.g., pressure clamping surfaces) that clamp the booklet are flat surfaces in parallel to the transport centerline 301 similarly to the auxiliary clamping plates 320 and 321.

The contact plate 330 is disposed downstream from the upper and lower clamping members 325 and 326. The contact plate 330 and an elevation unit 331 to move the contact plate 330 vertically in FIG. 8 together form a contact unit. The contact plate 330 moves vertically in FIG. 8 to obstruct the transport path 302 and away from the transport path 302, and a reference position used in detecting a displacement of the contact plate 330 can be set with the output from the contact plate HP detector SN5. When the contact plate 330 is away from the transport path 302, a top surface of the contact plate 330 serves as a transport guide for the booklet SB. Therefore, the top surface of the contact plate 330 is flat, in parallel to the sheet conveyance direction, that is, the transport centerline 301. For example, the elevation unit 331 to move the contact plate 330 can include rack-and-pinions provided on both sides of the contact plate 330, that is, a front side and a back side of the spine formation device 3, and a driving motor 332 to drive the pinions. With this configuration, the contact plate 330 can be moved vertically and set at a predetermined position by driving the driving motor 332.

Referring to FIG. 8, the discharge unit 33 is disposed downstream from the contact plate 330. The discharge unit 33 includes the pair of discharge guide plates 335 and the pair of discharge rollers 340 and 341 to discharge the booklet SB outside the spine formation device 3 after spine formation. The discharge unit 33 includes a roller disengagement mechanism, described later, to disengage the discharge rollers 340 and 341 from each other. The discharge rollers 340 and 341 are disengaged from each other when the flattened spine of the booklet passes between them, after which the discharge rollers 340 and 341 press against the booklet and discharge the booklet outside the spine formation device 3.

The transport detector SN1 detects the folded portion of the booklet SB. The position of the booklet SB during spine formation and the timing at which the discharge rollers 340 and 341 approach and move away from each other are set by adjusting the distance by which the booklet SB is transported from the position detected by the transport detector SN1.

More specifically, the distance by which the booklet SB is transported from the position detected by the sheet detector SN1 to the position at which the booklet SB is kept during spine formation is a sum of a first distance by which the booklet SB is moved from the detected position to the contact position between the folded portion and the contact plate 330 and a second distance (hereinafter also "predetermined conveyance distance for spine formation") from the contact position. The second distance can be predetermined in accordance with the amount of bulging, that is, the portion expanded in the thickness direction, necessary to shape the folded portion into the spine. This conveyance distance can be adjusted through pulse control, control using an encoder, or the like. Additionally, the discharge detector SN2 is provided upstream from the lower discharge roller 341, adjacent thereto, and detects the passage of the booklet SB in the transport path 302.

Figure 11:
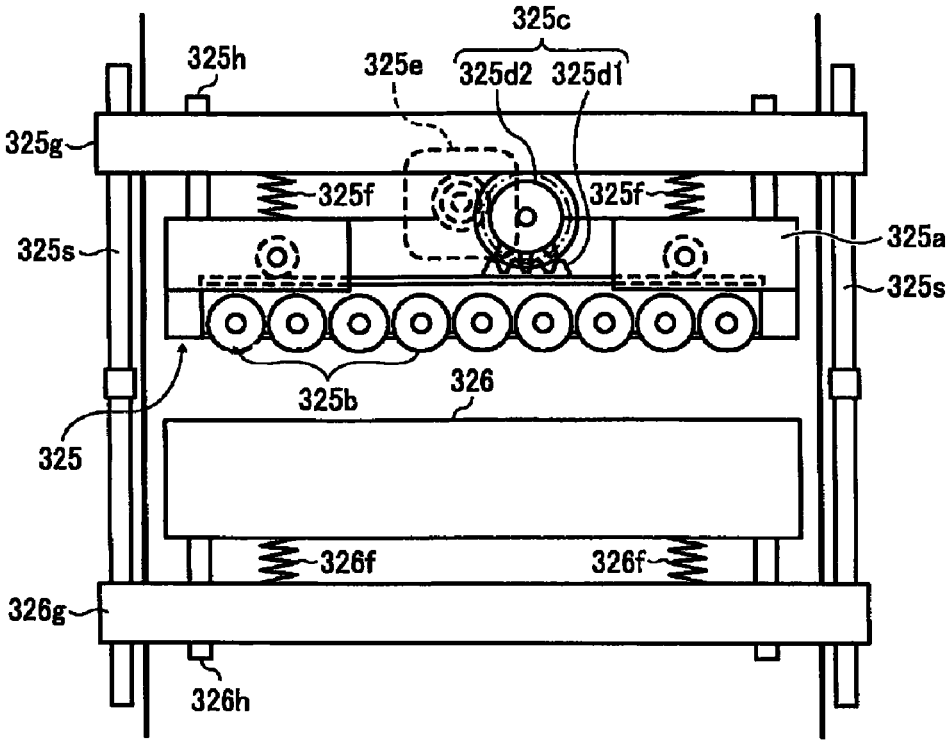
FIG. 11 is a front view illustrating a configuration of a clamping unit included in the spine formation device.

FIG. 11 is a front view illustrating a configuration of the clamping members 325 and 326 (clamping unit), and FIG. 12 is a side view of the clamping members 325 and 326 viewed from the right in FIG. 11.

In these drawings, the upper clamping member 325 includes a base 325*a*, the multiple pressure rollers 325*b* rotatably supported by the base 325*a*, a driving unit (rack-and-pinion) 325*c* including a rack 325*d*1 and a pinion 325*d*2, and a driving motor 325*e* serving as a driving source for driving the rack-and-pinion 325*c*. The rack-and-pinion 325*c* moves the base 325*a* reciprocally in the direction perpendicular to the sheet conveyance direction. Screw shafts 325*s* cause the upper clamping members 325 and 326 to approach and move away from each other.

As shown in FIG. 12, the base 325*a* includes a movable plate 325*a*1, and shafts of the respective pressure rollers 325*b* are rotatably supported by a side face of the movable plate 325*a*1 of the base 325*a*. The pressure rollers 325*b* are arranged in a single row perpendicular to the sheet conveyance direction with their outer circumferential surfaces projecting from a lower face of the base 325*a*. The movable plate 325*a*1 is attached to a side face of a lower portion of the base 325*a* so as to slide reciprocally in the direction perpendicular to the sheet conveyance direction. It is to be noted that the movable plate 325*a*1 moves reciprocally in the longitudinal direction of the spine of the bundle, perpendicular to the sheet conveyance direction. The rack 325*d*1 is provided in an upper portion of the movable plate 325*a*1, and the pinion 325*d*1 is provided on the base 325*a* so as to engage the rack 325*d*1. Further, the pinion 325*d*2 engage a gear attached to a driving shaft of the driving motor 325*e*. As the driving motor 325*e* rotates, the rack 325*d*1 is driven via the pinion 325*d*2, and the movable plate 325*a*1 moves together with the rack 325*d*1.

The range of movement of the movable plate 325*a*1 depends on the distance between the shafts of adjacent pressure rollers 355*b*. Although, in the configuration shown in FIG. 11, for example, nine pressure rollers 325*b* are arranged in the direction perpendicular to the sheet conveyance direction over the length (width) of the booklet SB in the direction perpendicular to the sheet conveyance direction, the number of the pressure rollers 325*b* is not limited thereto. The movable plate 325*a*1 is moved a distance equal to or greater than the interval between the shafts of two adjacent pressure rollers 355*b* regardless of the number of the pressure rollers 325*b*.

For example, although it depends on the sheet width and the positions of the pressure rollers 325*b* at the both ends in the sheet width direction perpendicular to the sheet conveyance direction, as long as the relative positions of the pressure rollers 325*b* at both ends and the sheet is such that the pressure rollers 325*b* at both ends can press against the both end portions of the booklet SB in the width direction, the booklet SB can be pressed over the entire width by the pressure rollers 325*b* when the movable plate 325*a*1 reciprocally moves a distance equal to half the interval between the pressure rollers 325*b*. Therefore, the number of the pressure rollers 325*b* and the interval between them are determined considering the width (i.e., the length in the direction perpendicular to the sheet conveyance direction) of the booklet SB to be processed.

As shown in FIG. 11, the upper clamping member 325 and the lower clamping member 326 respectively face supporters 325*g* and 326*g* and are biased by elastic members 325*f* and 326*f* to the supporters 325*g* and 326*g*. For example, the elastic members 325*f* and 326*f* may be compression springs. Guide rods 325*h* and 326*h* support the upper clamping member 325 and the lower clamping member 326 movably in the vertical direction, respectively. The screw shafts 325*s* support both end portion of the supporter 325*g* and both end portions of the supporter 326*g* in the width direction of the booklet. Each screw shaft 325*s* has a screw thread winding in opposite directions from a center portion in the vertical direction. The screw shafts 325*s* can be driven by a motor in both a normal direction and the reverse direction, and thus the supporters 325*g* and 326*g* can approach and move away from each other. Additionally, when the outer circumferential surfaces of the pressure rollers 325*b* are in contact with an upper surface of the lower clamping member 326, or the booklet placed between the upper and lower clamping members 325 and 326, and then the screw shafts 325*s* are driven to cause the pressure rollers 325*b* and the lower clamping member 326 to press against each other, a pressure is generated in accordance with the amount by which the elastic members 325*f* are compressed. The booklet placed between the upper and lower clamping members 325 and 326 can be squeezed with this pressure. Needless to say, the screw shafts 325*s* are positioned outside the area through which the booklet is transported.

Additionally, the screw shaft 320*s* similarly to the screw shafts 325*s* can cause the auxiliary clamping plates 320 and 321 to approach and move away from each other.

With this configuration, when the movable plate 325*a*1 is moved reciprocally a distance equal to half the interval between the pressure rollers 325*b* as described above, the pressure exerted by the pressure roller 325*b* and the lower clamping member 326 pressing against each other is applied to the booklet over the entire width of the booklet. Repeated reciprocal movement of the movable plate 325*a*1 can secure the folded lines of the spine of the booklet. The operation of the movable plate 325*a*1 is described in further detail later.

Additionally, each pressure roller 325*b* is chamfered on the downstream side in the sheet conveyance direction, on the lower side facing the booklet (facing side), and a tapered face 325*m* is formed. Thus, each pressure roller 325*b* is conical when viewed from a side as shown in FIG. 12. Similarly, an downstream edge portion of the lower clamping member 326, on the side facing the pressure rollers 325*b* (facing side) is chamfered, and a tapered face 326*m* is formed. The With this configuration, the leading-edge portion of the booklet clamped between the pressure rollers 325*b* and the lower clamping member 326 can be squeezed into a shape symmetrical vertically. In other words, in the downstream end portion of the clamping unit, the portion of the clamping unit pressed against the booklet is symmetrical or substantially symmetrical relative to the transport centerline 301 (shown in FIG. 8) in a vertical cross section along the long axis of the pressure roller 325*b*.

FIGS. 13 through 19 illustrate spine formation performed by the spine formation device 3 to flatten the spine of the booklet SB as well as the front cover side and the bock cover side thereof.

Referring to FIGS. 13 through 19, operations performed by the spine formation device 3 to flatten the folded portion, that is, the spine, of the booklet SB are described in further detail below.

Referring to FIG. 13, according to a detection signal of the booklet SB generated by an entrance sensor, not shown, of the spine formation device 3 or the folded portion detector 293 (shown in FIG. 7) of the bookbinding device 2, the respective portions of the spine formation device 3 perform preparatory operations to receive the booklet SB. In the preparatory operations, the pair of transport belts 311 and 312 starts rotating. Additionally, the upper auxiliary clamping plate 320 and the lower auxiliary clamping plate 321 move to the respective home positions detected by the auxiliary clamping plate RP detector SN3, move toward the transport centerline 301 until the distance (hereinafter "transport gap E") therebetween becomes a predetermined distance, and then stop at those positions. Similarly, the upper clamping member 325 and the lower clamping member 326 move to the respective home positions detected by the clamping plate HP detector SN4, move toward the transport centerline 301 until the distance (hereinafter "transport gap") therebetween becomes a predetermined distance, and then stop at those positions.

It is to be noted that, because the pair of auxiliary clamping plates 320 and 321 as well as the pair of clamping members 325 and 326 are disposed and move symmetrically relative to the transport centerline 301, when only one of the counterparts in the pair is detected at the home position, it is known that the other is at the home position as well. Therefore, the auxiliary clamping plate HP detector SN3 and the clamping plate HP detector SN4 are disposed on only one side of the transport centerline 301. The contact plate 330 moves to the home position detected by the contact plate HP detector SN5, moves toward the transport centerline 301 a predetermined distance, and then stops at a position obstructing the transport path 302. This state before the booklet SB enters the spine formation device 3 is shown in FIG. 13.

Figure 14:
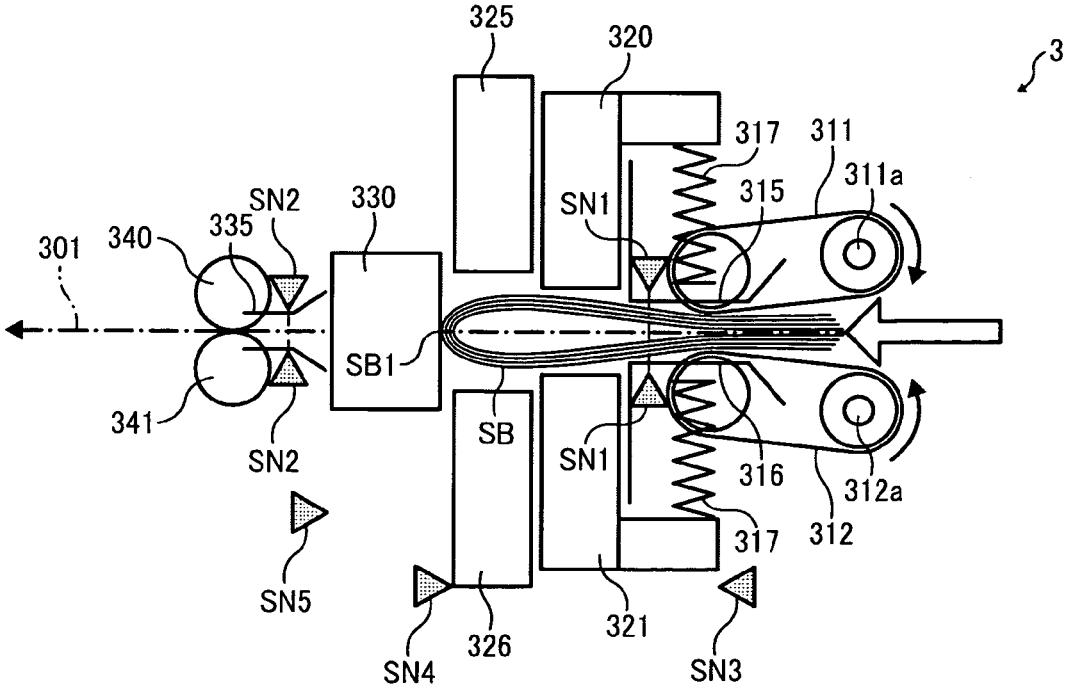
FIG. 14 illustrates a process of spine formation performed by the spine formation device in which the leading edge of the bundle of folded sheets is in contact with a contact plate.

In this state, when the booklet SB is forwarded by the discharge rollers 231 of the bookbinding device 2 to the spine formation device 3, the rotating transport belts 311 and 312 transport the booklet SB inside the device as shown in FIG. 13. The transport detector SN1 detects the folded portion SB1 of the booklet SB. The booklet SB is transported by the transport belts 311 and 312 the predetermined distance that is the sum of the distance until the folded portion SB1 contacts the contact plate 330 (first distance) and the distance necessary to form the spine (conveyance distance for spine formation") by expanding the folded portion SB1 in the thickness direction, after which the booklet SB is kept at that position as shown in FIG. 14. The predetermined conveyance distance for spine formation is set corresponding to the sheet-related data of the booklet SB such as the sheet thickness, the sheet size, the quantity of sheets, and the special sheet classification of the booklet SB.

Figure 15:
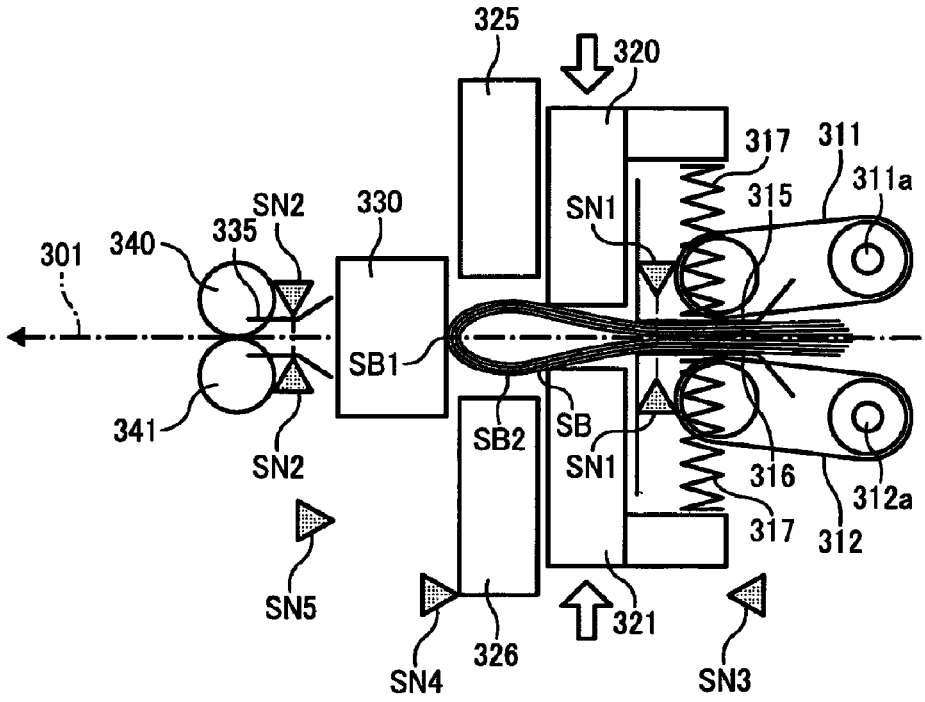
FIG. 15 illustrates a process of spine formation performed by the spine formation device, in which a pair of auxiliary clamping plates approaches the bundle of folded sheets to clamp it therein.
Figure 16:
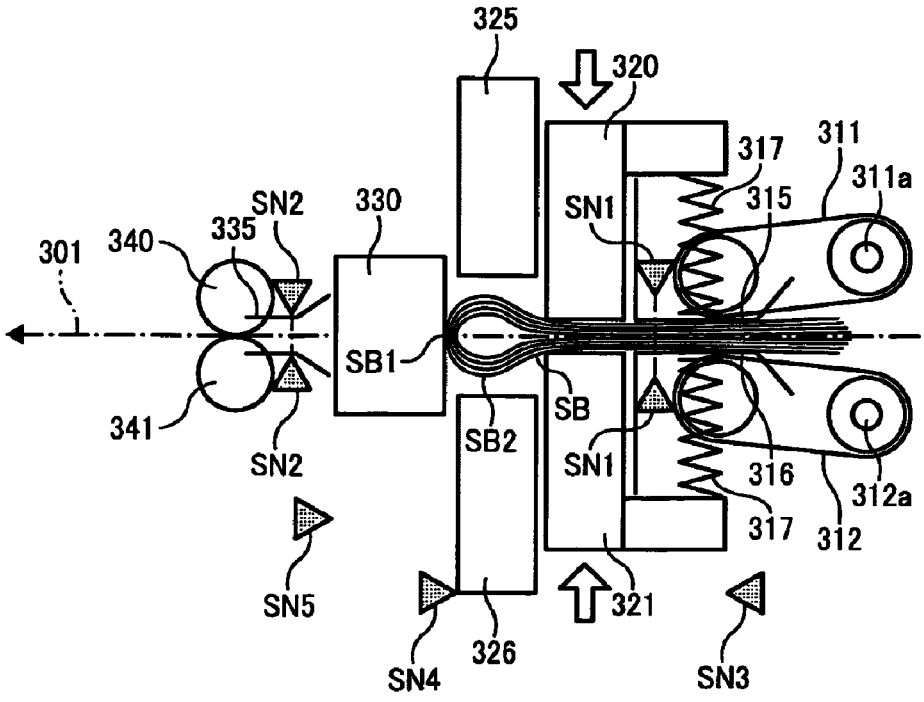
FIG. 16 illustrates a process of spine formation performed by the spine formation device in which the pair of auxiliary clamping plates squeezes the bundle of folded sheets.

When the booklet SB is stopped in the state shown in FIG. 14, referring to FIG. 15, the auxiliary clamping plates 320 and 321 start approaching the transport centerline 301, and the pair of guide plates 315 and 316 presses against the booklet SB clamped therein with the elastic force of the pressure springs 317 initially. After the pair of guide plates 315 and 316 start applying a predetermined pressure to the booklet SB, the auxiliary clamping plates 320 and 321 further approach the transport centerline 301 to squeeze the booklet SB in the portion downstream from the portion clamped by the guide plates 315 and 316 and then stop moving when the pressure to the booklet SB reaches a predetermine or given pressure, with the booklet SB held with the predetermined pressure as shown in FIG. 16. With the folded leading-edge portion SB1 of the booklet SB pressed against the contact plate 330, the bulging portion SB2 upstream from the folded leading-edge portion SB1 is larger than that shown in FIG. 15.

Figure 17:
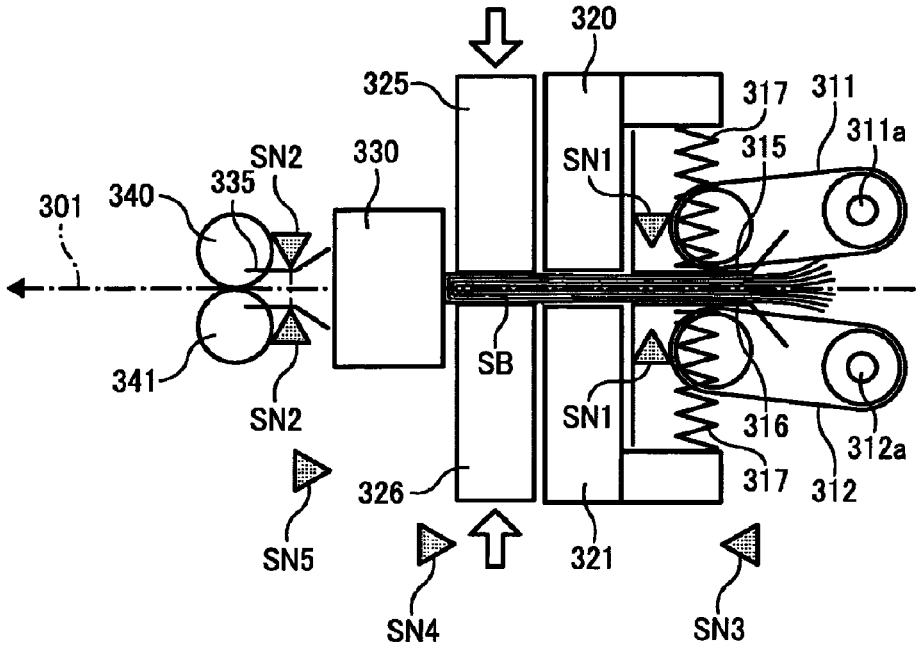
FIG. 17 illustrates a process of spine formation performed by the spine formation device in which a pair of clamping plates squeezes the bundle of folded sheets.

After the auxiliary clamping plates 320 and 321 squeeze the booklet SB as shown in FIG. 16, the clamping members 325 and 326 start approaching the transport centerline 301 as shown in FIG. 17. With this movement, the bulging portion SB2 is localized to the side of the folded leading-edge portion SB1, pressed gradually, and then deforms following the shape of the space defined by the pressure rollers 325*b* of the upper clamping member 325, the lower clamping member 326, and the contact plate 330. The movable plate 325*a* is moved reciprocally by the driving motor 325*e* after the clamping members 325 and 326 stop approaching each other or while the clamping members 325 and 326 approach each other, squeezing the booklet SB. Accordingly, the multiple pressure rollers 325*b* roll on the booklet SB reciprocally in the state shown in FIG. 17, thus pressing the folded portion of the booklet SB. At that time, since each pressure roller 325*b* is in contact with a relatively smaller area (a point) of the booklet SB differently from a comparative configuration in which the upper clamping member 325 is planar entirely, the pressure exerted by the pressure roller 325*b* is localized to that point. Therefore, the pressure in the direction indicated by arrows shown in FIG. 17, which is caused by the torque of the screw shafts 325*s* in the present embodiment, can be smaller than that in the comparative configuration in which the area of the planar clamping pressed against the upper surface of the booklet SB is larger.

Figure 18:
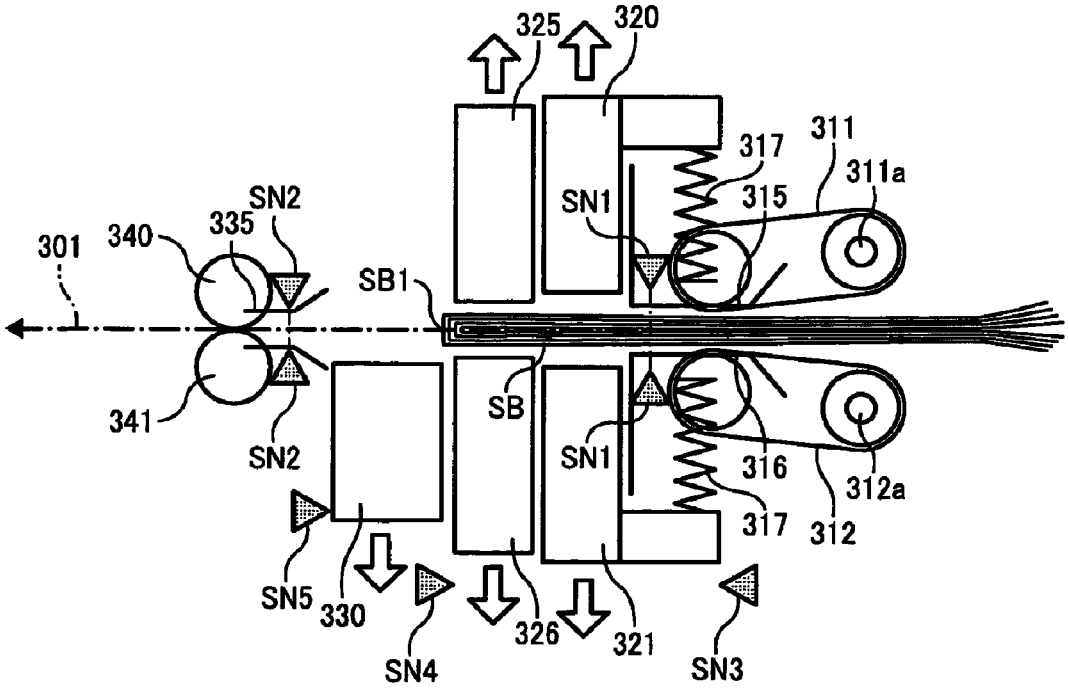
FIG. 18 illustrates completion of spine formation performed by the spine formation device in which the pair of auxiliary clamping plates and the pair of clamping members are disengaged from the bundle of folded sheets.
Figure 19:
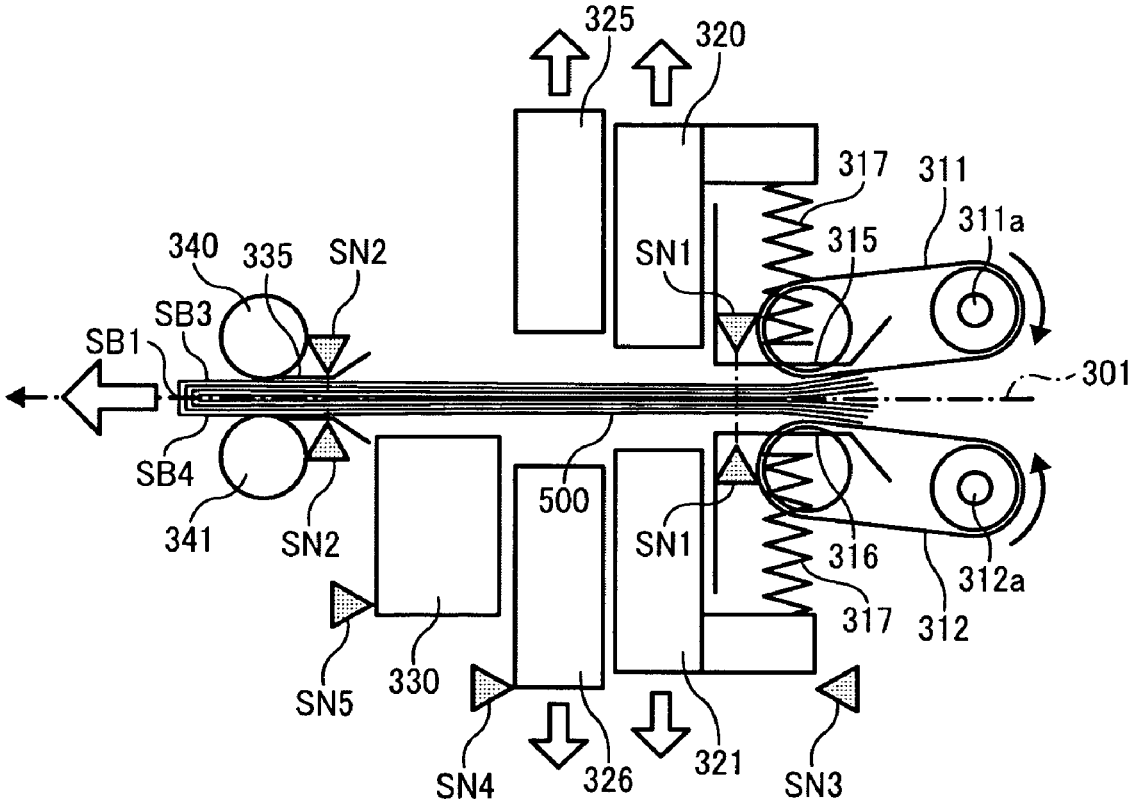
FIG. 19 illustrates a state in which the bundle of folded sheets is discharged from the spine formation device after spine formation.

By moving the movable plate 325*a*1 reciprocally at least the distance equal to half the interval between the axes of the pressure rollers 325*b* as described above, the pressure exerted by the pressure roller 325*b* can be applied to the booklet over the entire sheet width. As a result, the folded portion SB1 of the booklet SB can be flattened following the surface of the contact plate 330, and thus the spine of the booklet SB is made flat. In addition, leading-edge portions SB3 and SB4 of the booklet SB on the front side (front cover) and the back side (back cover) are flattened as well. Thus, as shown in FIG. 19, booklets having square spines can be produced Subsequently, as shown in FIG. 18, the auxiliary clamping plates 320 and 321 and the clamping members 325 and 326 move away from the booklet SB to predetermined or given positions (standby positions), respectively. The contact plate 330 moves toward the home position and stops at a position where the top surface thereof guides the booklet SB.

After the auxiliary clamping plates 320 and 321, the clamping members 325 and 326, and the contact plate 330 reach the respective standby positions, as shown in FIG. 19, the transport belts 311 and 312 and the pair of discharge rollers 340 and 341 start rotating, thereby discharging the booklet SB outside the spine formation device 3. Thus, a sequence of spine formation operations is completed.

The transport belts 311 and 312 and the pair of discharge rollers 340 and 341 stop rotating after a predetermined time period has elapsed from the detection of the booklet SB by the discharge detector N2. Simultaneously, the respective movable portions return to their home positions. When subsequent booklets SB are sequentially sent form the bookbinding device 2, the time point at which the rotation of the transport belts 311 and 312 and the discharge rollers 340 and 341 is stopped is varied according to the transport state of the subsequent booklet SB. Additionally, it may be unnecessary to return the respective movable portions to their home positions each time, and the position to receive the booklet SB may be varied according to the transport state of and the data relating to the subsequent booklet SB. It is to be noted that the CPU 3-1 of the spine formation device 2 in the control circuit of the bookbinding system performs these adjustments.

Although, in the present embodiment, the pressure rollers 325*b* are rotationally attached to the movable plate 325*a*1 and are so-called driven rollers moved by the movable plate 325*a*1 driven by the driving motor 325*e*, alternatively, the driving motor 325*e* may drive the pressure roller 325*b* directly to roll on the booklet. Additionally, although the lower clamping member 326 is planar with a relatively large area of it is in contact the booklet SB, receiving the pressure exerted by the multiple pressure rollers 325*b* via the booklet SB, alternatively, the lower clamping member 326 can be constructed of multiple rollers disposed facing the respective pressure rollers 325*b* of the upper clamping member 325 similarly. In such a configuration, pressure is applied to the booklet SB in nips where the multiple rollers press against the respective pressure rollers 325*b* while the folded leading-edge portion SB1 of the booklet SB is pressed against the contact plate 330, thus shaping the spine of the booklet SB.

Figure 22:
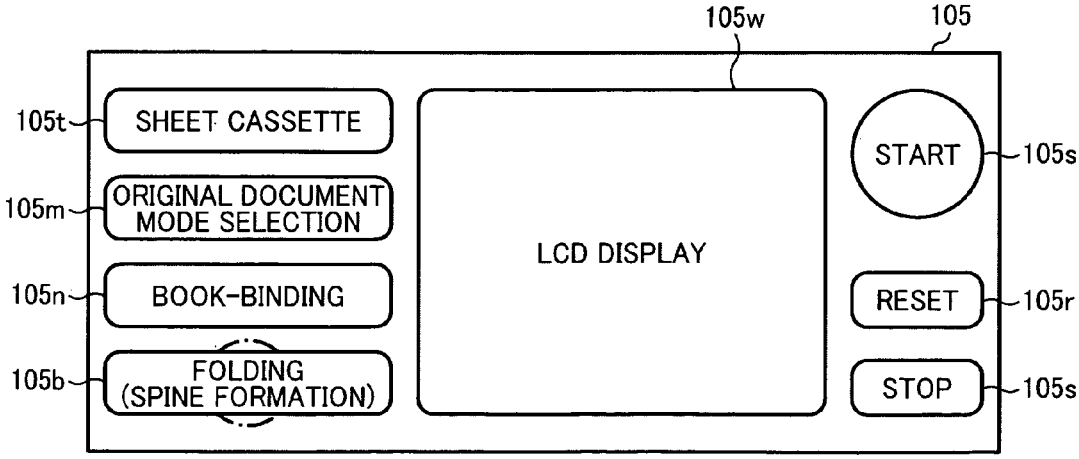
FIG. 22 illustrates a display of a control panel.
Figure 23B:
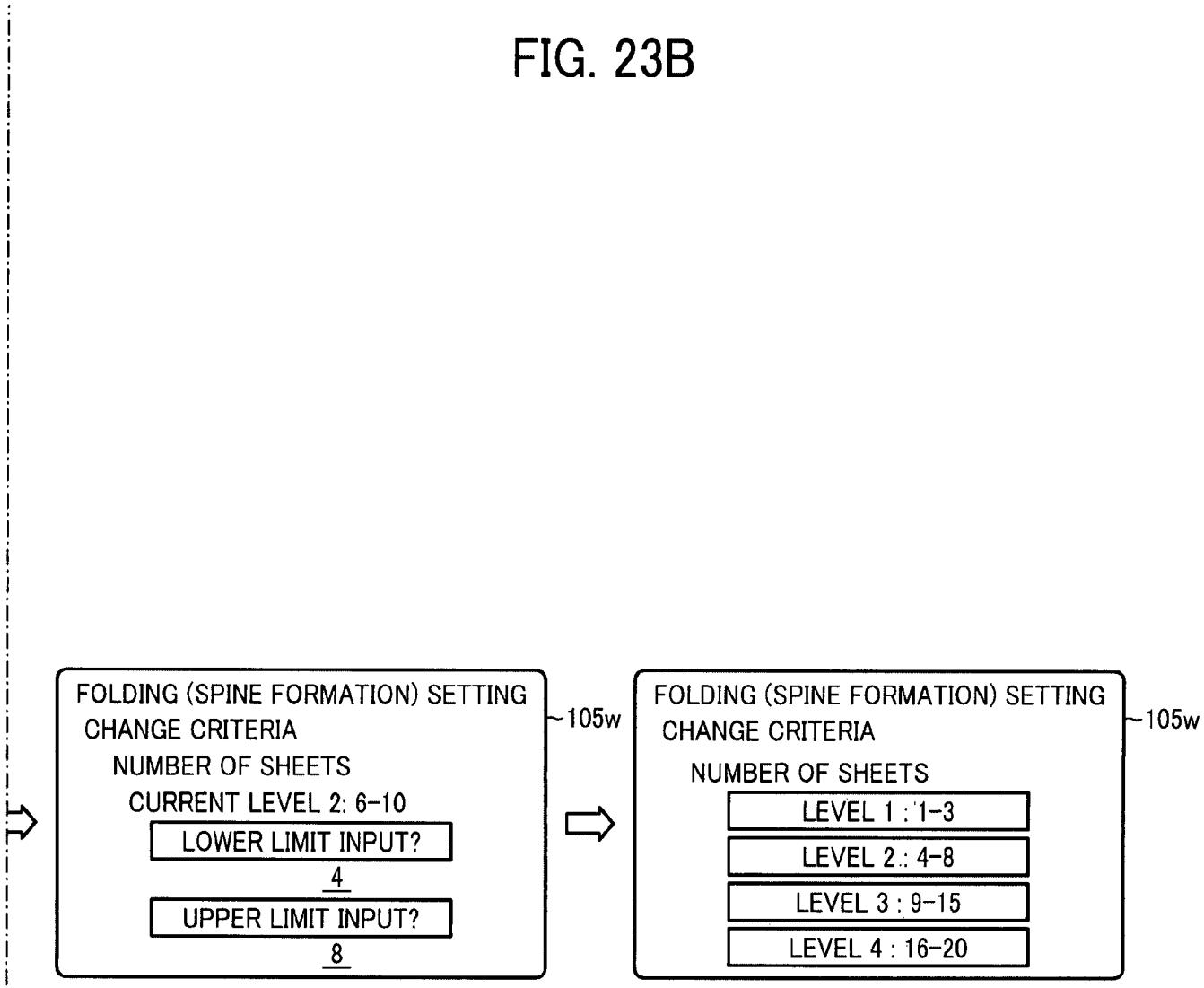
FIG. 23 illustrates various indications displayed on the control panel.
Figure 24:
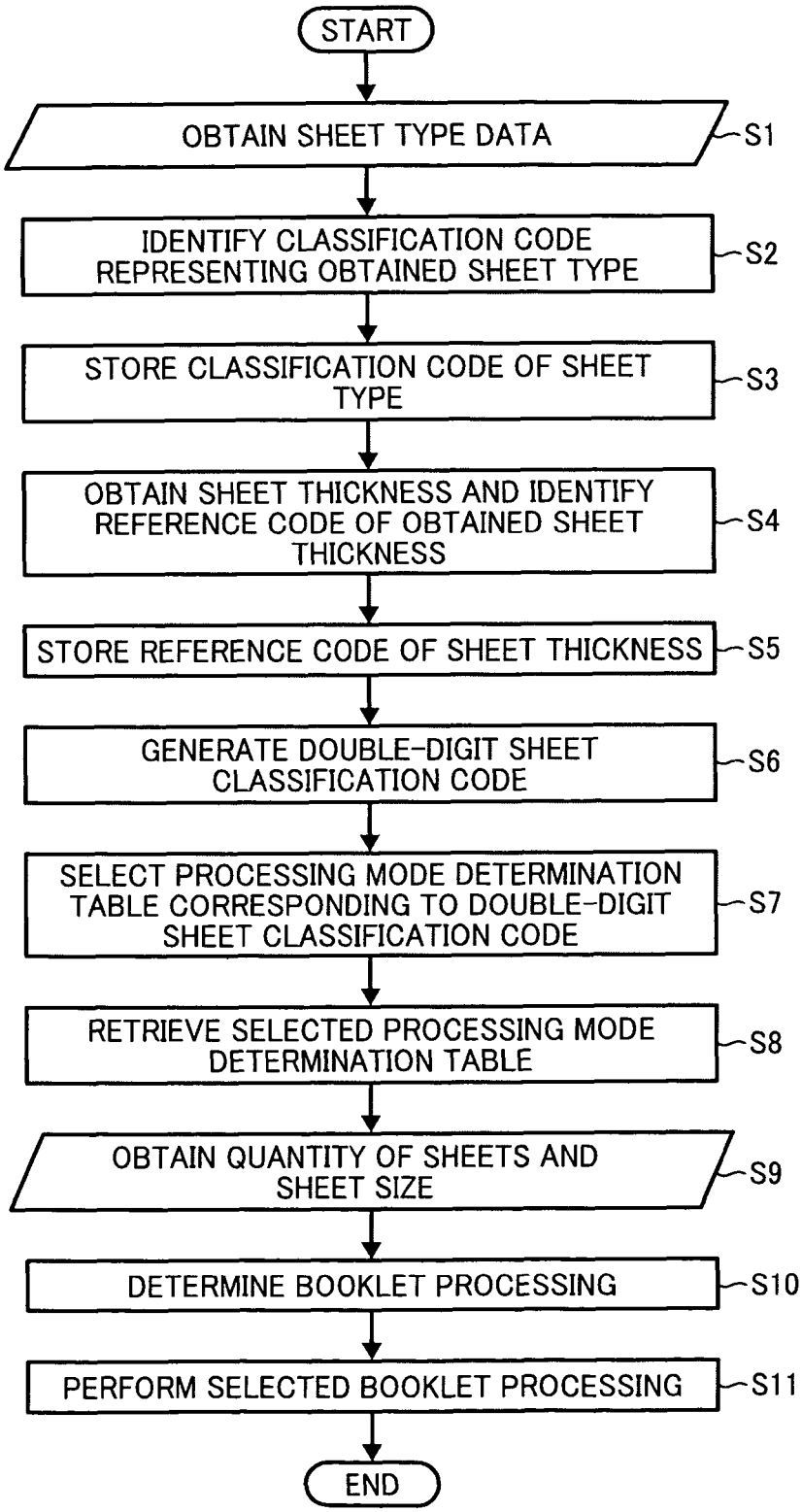
FIG. 24 is a flowchart illustrating a procedure of processing of a bundle of folded sheets.

It is to be noted that, although the portion of the clamping unit to press against the folded leading-edge portion SB1 of the booklet SB has such a cross-sectional shape that the upper side (the upper clamping member 325) and the lower side (the lower clamping member 326) of it are symmetrical and chamfered in the present embodiment, the spine formation described below with reference to FIGS. 22 to 24 is possible even when the clamping unit is not chamfered. The chamfered shape shown in FIGS. 11 and 12 is advantageous in that a component force for moving the folded leading-edge portion SB1 of the booklet SB to the contact plate 330 is generated, a similar degree of flatness of the spine can be attained even when the pressure between the upper clamping member 325 and the lower clamping member 326 is smaller compared with a configuration in which the clamping unit is not chamfered.

A control block of the bookbinding system is described below with reference to FIG. 20.

As shown in FIG. 20, the control circuit of the bookbinding system enables the online bookbinding system. FIG. 20 is a block diagram illustrating a configuration of online control of the bookbinding system. The post-processing apparatus 1 is connected to the image forming apparatus (MFP) 100 including the engine 110, and the bookbinding device 2 is connected to the post-processing apparatus 2. Further, the spine formation device 3 is connected to the bookbinding device 2. The MFP 100, the post-processing apparatus 1, the bookbinding device 2, and the spine formation device 3 respectively include the CPUs 100-1, 1-1, 2-1, and 3-1. The MFP 100 further includes an engine 110 and a communication port 100-2. The post-processing apparatus 1 further includes communication ports 1-2 and 1-3, the binding device 2 further includes communication ports 2-2 and 2-3, and the spine formation device 3 further includes a communication port 3-2. The MFP 1 and the post-processing apparatus 1 can communicate with each other using the communication ports 100-2 and 1-2, and post-processing apparatus 1 and the bookbinding device 2 can communicate with each other using the communication ports 1-3 and 2-2. Similarly, the bookbinding device 2 and the spine formation device 3 can communicate with each other using the communication ports 2-3 and 3-2. Additionally, the CPU 100-1 of the image forming device 100 controls indications on the operation panel 105 and inputs from users to the operation panel 105, and thus the operation panel 105 serves as a user interface.

Each of the image forming apparatus 100, the post-processing apparatus 1, the bookbinding device 2, and the spine formation device 3 further includes a read-only memory (ROM) and a random-access memory (RAM). Each of the CPUs 100-1, 1-1, 2-1, and 3-1 thereof reads out program codes from the ROM, runs the program codes in the RAM, and then performs operations defined by the program codes using the RAM as a work area and a data buffer. With this configuration, various control and operations described above or below are performed. The MFP 100, the post-processing apparatus 1, the bookbinding device 2, and the spine formation device 3 are connected in line via the communication ports 100-2, 1-2, 1-3, 2-2, 2-3, and 3-2. When post-processing of sheets is performed online, the CPUs 1-1, 2-1, and 3-1 of the post-processing apparatus 1, the bookbinding device 2, and the spine formation device 3 communicate with the CPU 100-1 of the image forming apparatus 100, and thus the post-processing of sheets is controlled by the CPU 100-1 of the MFP 100.

It is to be noted that, in this specification, "inline processing" means that at least two of image formation, processing of sheets, stapling of a bundle of sheets, and spine formation of the booklet are performed sequentially while the sheets are transported through the bookbinding system. Additionally, the bookbinding and spine formation is performed in accordance with characteristic data of the booklet SB (i.e., sheet-related variables). The characteristic data of the booklet SB includes the quantity of sheets and sheet thickness at least and may also include sheet size and the type of sheets, that is, special sheet classification. When the characteristic data of the booklet SB includes the special sheet classification, the characteristic data includes data for distinguishing the type of special sheets among overhead projector (OHP) sheets, label sheets, coated sheets, sheets folded into special shapes (hereinafter also simply "folded sheets"), creased sheets, and perforated sheets.

Additionally, the CPUs 100-1, 1,1, 2-1, and 3-1, the storage device including the ROMs and RAMs (not shown) of the image forming apparatus 100, the post-processing apparatus 1, the bookbinding device 2, and the spine formation device 3, the operation panel 105 of the image forming apparatus 100 function as resources when spine formation is formed via computers.

Figure 21:
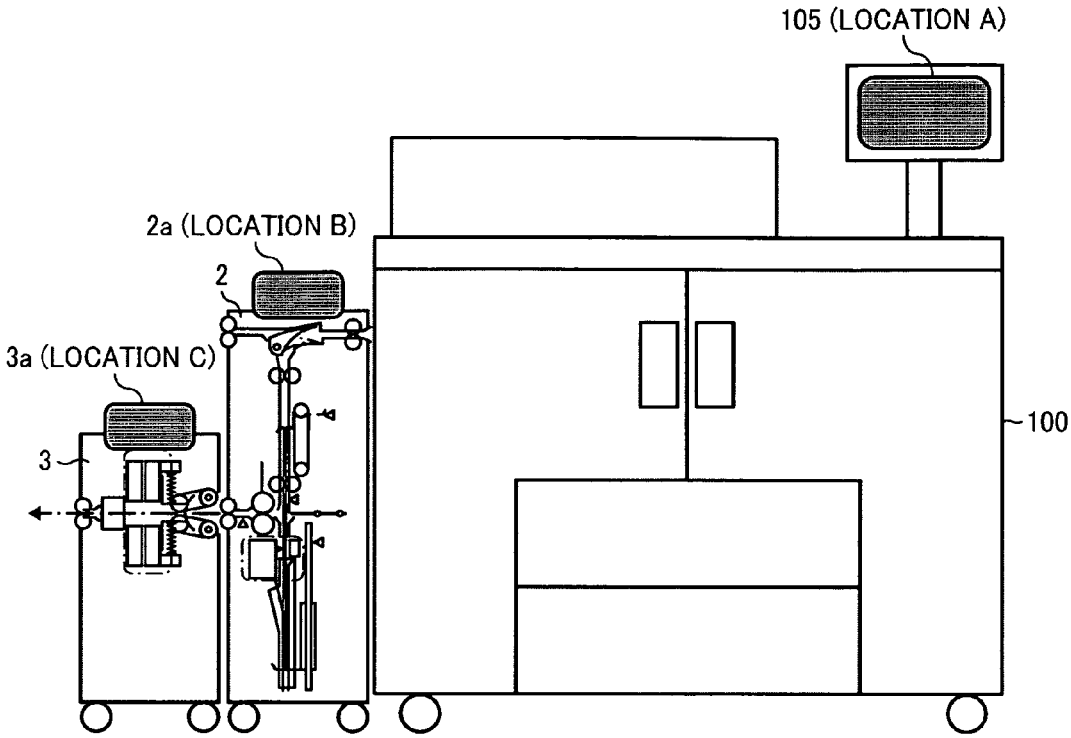
FIG. 21 is a diagram that illustrates a configuration of a bookbinding system in which the post-processing apparatus is removed from the bookbinding system shown in FIG. 20, and the saddle-stapling device as well as the spine formation device is connected to the downstream side of the image forming apparatus.

FIG. 21 is a diagram that illustrates a configuration of a bookbinding system in which the post-processing apparatus 1 is removed from the configuration shown in FIG. 20, and the bookbinding device 2 as well as the spine formation device 3 is connected to the downstream side of the image forming apparatus 100.

Although the configuration according to the present embodiment can flatten the spine of the booklet SB, flattening the spine of the booklet SB is not always performed in practice. Therefore, in the present embodiment, the user can select one of the following three options regarding how to process the booklet (booklet processing modes) or one of the booklet processing modes is selected in accordance with physical conditions, in particular, sheet-related variables such as the quantity of sheets, sheet size, sheet thickness, sheet type, and the like. Mode 1: Spine formation mode in which booklets are squeezed and their folded leading-edge portions (spines) are pressed against the contact plate 330, thus flattened. Mode 2: Squeezing mode in which booklets are squeezed but their spines are not flattened. Mode 3: Through mode in which booklets are not squeezed and their spines are not flattened. One of the above-described options (modes) 1, 2, and 3 is selectable according to at least one of multiple sheet-related variables, namely, the quantity of sheets, the sheet size, the sheet thickness, and the sheet type (special sheet classification). Additionally, although criteria of the sheet-related variables for selecting the booklet processing mode are preset, the criteria can be changed.

The mode 1, spine formation mode, is to perform the processes shown in FIGS. 13 through 19 so as to press the folded portion SB1 of the booklet SB against the contact plate 330, thereby flattening the folded portion SB1 and minimizing the bulging of the booklet SB. Flattening the spine, however, is not always necessary or preferred. That is, the user may desire to reduce the bulging of the booklet SB, making it thinner, without flattening the spine, or prefer to shorten the processing time required for bookbinding. The mode 2, squeezing mode, responds such a request. In the squeezing mode, the booklet SB is conveyed to a position upstream from the contact plate 330 in a manner that its folded leading-edge portion is not brought into contact with the contact plate 330. At that position, the booklet SB is squeezed, and then the pressure rollers 325*b* are moved in the width direction, thereby squeezing the folded portion of the booklet over the entire sheet width, after which the booklet SB is released from the auxiliary clamping plates 320 and 321 and the clamping members 325 and 326. Thus, the bulging of the booklet can be reduced, that is, the thickness of the booklet can be reduced also in the squeezing mode although the effect is lower than that in the spine formation mode.

The user can select one of them or change the selection via the control panel 105, which serves as a control panel of the image forming apparatus 100 (location A) in the system shown in FIG. 21. Alternatively, a similar control panel may be provided in the bookbinding device 2 (location B) or the spine formation device 3 (location C). In FIG. 21, reference characters 2*a* and 3*a* represent the control panel of the bookbinding device 2 and that of the spine formation device 3, respectively.

FIG. 22 illustrates a display of control panel 105 at the location A, that is, provided in the image forming apparatus 100.

When the control panel is at the location B or location C, a liquid crystal (LC) window 105 is required. More specifically, setting and selection made in one of the respective apparatuses in the bookbinding system, which are connected inline as shown in FIG. 20, are transmitted to other apparatuses, and processing to be executed in the apparatus other than the apparatus in which the user made setting or selections are executed in that apparatus. The processing performed in only the image forming apparatus 100, however, cannot be designated from the apparatuses or device positioned downstream from the image forming apparatus 100. That is, the bookbinding device 2 controls itself and the spine formation device 3, and the spine formation device 3 controls only itself. Data relating to control or detection made in the bookbinding device 2 or the spine formation device 3 are transmitted to the upstream apparatus.

Referring to FIG. 22, the control panel 105 includes the LC display 105*w* positioned in a center portion thereof. A SHEET CASSETTE button 105*t*, an ORIGINAL DOCUMENT MODE SELECTION button 105*m*, a BOOKBINDING button 105*n*, a FOLDING/SPINE FORMATION button 105*b* serving as a processing selector, are provided on the left, in that order, from the top, and a START button 105*s*, a RESET button 105*r*, and a STOP button 105*st* are provided on the right in FIG. 22. The LC display 105*w* is a so-called touch panel and displays messages, input areas, and selection buttons of multiple levels. The user can instruct the apparatus to execute the function indicated by that button by touching that button. According to the function thus selected, display of lower level is changed or the selected function is executed.

One of the above-described options 1 to 3 is selected based on criteria shown in tables 1 and 2 shown below.

TABLE 1

| | Special sheet classification | | | |
|---|---|---|---|---|
| | Standard sheets | Coated sheets | Folded sheets | Creased sheets |
| Classification code | A | B | C | D |

Table 1 is a table of reference characters (classification code) of sheet type data used in setting the option. As shown in table 1, reference characters "A", "B", "C", and "D" represent standard sheets, coated sheets, folded sheets, and creased sheets, respectively.

TABLE 2

| | Sheet thickness T (g/m2) | |
|---|---|---|
| | T ≦ 90 | T > 90 |
| Reference in setting | 1 | 2 |

Table 2 is a table of criteria to judge the sheet thickness level and their reference number (reference code) used in setting the option. In table 2, reference character T represents the sheet thickness, and a sheet thickness of equal to or less than 90 g/m$^2$ is level "1" and a sheet thickness greater than 90 g/m$^2$ is level "2".

A table corresponding to the sheet type and sheet thickness for deciding the booklet processing mode (hereinafter "processing mode determination table") is retrieved according to double-digit sheet classification codes, for example, "A1", "B2", or "C1", the first and second characters of which represent the sheet type and the sheet thickness, respectively.

Tables 3, 4, and 5 shown below are examples of the processing mode determination table. It is to be noted that, although the booklet processing mode is decided based on the sheet width as the sheet size in tables 3, 4, and 5, alternatively, the processing mode may be decided based on regular sheet sizes such as A3, A4, B4 and B5. That is, the sheet size may include the length of sheets perpendicular to the sheet size in addition to the sheet width.

TABLE 3

| Sheet classification code | | Number of sheets | | | |
|---|---|---|---|---|---|
| A1 | | 1 to 5 | 6 to 10 | 11 to 15 | 16 to 20 |
| Sheet width: B (mm) | B ≦ 220 | Mode 3 | Mode 2 | Mode 1 | Mode 1 |
| | B > 220 | Mode 3 | Mode 2 | Mode 1 | Mode 1 |

Table 3 is a processing mode determination table for sheet classification code "A1", the sheet type A (standard sheet) with the sheet thickness level 1 (T≦90 g/m$^2$). The booklet processing mode is decided based on the relation between the quantity of sheets and the sheet width. According to table 3, speed has priority when the quantity of sheets is smaller, and reducing the thickness of the booklet has priority when the quantity of sheets is larger.

TABLE 4

| Sheet classification code | | Number of sheets | | | |
|---|---|---|---|---|---|
| B2 | | 1 to 5 | 6 to 10 | 11 to 15 | 16 to 20 |
| Sheet width: B (mm) | B ≦ 220 | Mode 2 | Mode 2 | Mode 2 | Mode 1 |
| | B > 220 | Mode 2 | Mode 2 | Mode 2 | Mode 1 |

Table 4 is a processing mode determination table for sheet classification code "B2", the sheet type B (coated sheet) with the sheet thickness level 2 (T>90 g/m$^2$). The booklet processing mode is decided based on the relation between the quantity of sheets and the sheet width. Referring to table 4, reducing the thickness of the booklet has priority even when the quantity of sheets is relatively small. Mostly the mode 2, squeezing mode without flattening the folded leading-edge portion of the bundles, is selected because bundles of coated sheets often consist of double-page spreads. The mode 1, spine formation, is selected when the quantity of sheets is relatively large.

TABLE 5

| Sheet classification code | | Number of sheets | | | |
|---|---|---|---|---|---|
| D1 | | 1 to 5 | 6 to 10 | 11 to 15 | 16 to 20 |
| Sheet width: B (mm) | B ≦ 220 | Mode 3 | Mode 2 | Mode 2 | Mode 2 |
| | B > 220 | Mode 3 | Mode 2 | Mode 2 | Mode 2 |

Table 5 is a processing mode determination table for sheet classification code "D1", the sheet type D (creased sheet) with the sheet thickness level 1 (T≦90 g/m$^2$). The booklet processing mode is decided based on the relation between the quantity of sheets and the sheet width. Because the sheets are creased, the mode 3, not to squeeze the booklet, is selected when the quantity of sheets is relatively small. When the quantity of sheets is relatively large, the mode 2 (squeezing mode) is selected to prevent deformation of creased portions because the thickness of the booklet can be reduced sufficiently by squeezing the booklet only.

It is to be noted, four levels are set as the quantity of sheets in tables 3, 4, and 5, and these levels can be changed in displays (f) and (g) shown in FIG. 23. It is to be noted that, the quantity of sheets and the sheet size may be measured by the spine formation device 3. Alternatively, these sheet-related variables may be transmitted to the spine formation device 3 from the upstream apparatus, the image forming apparatus 100 or the bookbinding device 2.

FIG. 23 illustrates displays (a) through (h) that appear on the LC display 105*w* of the control panel 105 of the image forming apparatus 100.

When the user touches or presses the FOLDING/SPINE FORMATION button 105*b* in the control panel 105 shown in FIG. 22, the display (a) appears on the LC display 105*w*. The display (a) shown in FIG. 23 is for setting processing of booklets and includes a CHANGE ALL button 105*w*1, a CHANGE INDIVIDUALLY button 105*w*2, and a CHANGE CRITERIA button 105*w*3 selectable in setting of folding (spine formation) the booklet. The CHANGE CRITERIA button 105*w*3 serve as a processing mode selection criteria changer to change the criterion of the sheet-related variable, in accordance with which the processing of the bundle of folded sheets is selected.

When the user touches or presses the CHANGE ALL button 105*w*1 in the display (a) in FIG. 23, the indication is switched to the display (b) shown in FIG. 23. The display (b) is for changing the booklet processing mode of multiple booklets SB, for example, a batch of booklets, at once and includes a CHANGE ALL TO MODE 1 button 105*wa*2, a CHANGE ALL TO MODE 2 button 105*wa*2, and a CHANGE ALL TO MODE 3 button 105*wa*3. When one of these buttons is pressed, all booklets SB are processed in the selected processing mode.

When the user touches or presses the CHANGE INDIVIDUALLY button 105*w*2 in the display (a) in FIG. 23, the indication is switched to the display (c) shown in FIG. 23. The display (c) is for changing the processing mode of multiple booklets SB individually. After the user can input the quantity of sheets, the sheet size, the sheet thickness, and the sheet type in the display (c), it is switched to the display (d). The display (d) includes the data related to the booklet SB input by the user, for example, the quantity of sheets: 1 to 5, the sheet size: A3, the sheet thickness: standard (52 to 80 gsm), and the sheet type: coated sheets in addition to current processing mode, which is mode 1 in FIG. 3 (*d*). The options of the processing modes, mode 1 to 3 are also displayed in the display (d). If the user prefers the mode 2 or 3 to the currently selected mode 1, the user touches or presses "MODE 2" or "MODE 3" at the bottom in the display (d) shown in FIG. 23. If the user prefers the mode 1 currently set, the user touches or presses "MODE 1" on the left at the bottom in the display (d). Then, the booklet is processed in one of the modes 1 to 3 selected by the user. The levels of the quantity of sheets in tables 3, 4, and 5 used to decide the processing mode can be changes in the display (e).

When the user presses the CHANGE CRITERIA button 105*w*3 in the display (a) in FIG. 23, the indication is switched to the display (e) shown in FIG. 23. The display (e) includes "NUMBER OF SHEETS", "SHEET SIZE", "SHEET THICKNESS", and "SHEET TYPE". When the user desires to change criteria of these items related to the booklet for determining the processing mode, the user can select that item in the display (e). For example, when the user touches or presses "NUMBER OF SHEETS" in FIG. 23 (*e*), the indication is switched to the display (f). In the display (f), four levels of the quantity of sheets are set as follows: "LEVEL 1", one to five sheets, "LEVEL 2", six to ten sheets, "LEVEL 3", 11 to 15 sheets, and "LEVEL 4", 16 to 20 sheets. When the user selects "LEVEL 1" in FIG. 23 (*f*), the indication is switched to the display (g) for setting the range of the quantity of sheets classified as level 1. The display (g) in FIG. 23 includes buttons for enabling the user to input the lower limit and the upper limit of level 1 as well as entry fields of them. For example, when the user inputs "4" and "8" in the lower and upper limits entry fields, respectively, the indication is switched to the display (h) in FIG. 23 in which the number of sheets is classified as follows: level, 1 to 3 sheets, level 2, 4 to 8 sheets, level 3, 9 to 15 sheets, and level 4, 16 to 20 sheets. Thus, the number of sheets classified as other levels are also changed in accordance with the changed level 2. According to the level thus set, the correlations between the number of sheets and the processing modes shown in tables 3, 4, and 5 are changed, and the processing mode of the booklet is selected in accordance with the changed relation.

FIG. 24 is a flowchart of determination of booklet processing mode performed by the CPU 3-1 of the spine formation device 3.

In the flowchart of FIG. 24, at S1 the CPU 3-1 obtains the sheet type data of the booklet. The sheet type data relates to the type (and thickness) of sheets. In the booklet processing determination shown in FIG. 24, there are four sheet types, and the reference codes "A" though "D" are used as the classification codes of standard sheets, coated sheets, folded sheets, and creased sheets, respectively, as shown in table 1. At S2, the CPU 3-1 identifies the classification code of the obtained sheet type based on table 1, the table of the sheet type classification codes, and, at S3, stores the classification code of sheet type in the memory. At S4, the CPU 3-1 obtains the thickness of sheets, decides the sheet thickness level according to table 2, and obtains the reference code of the sheet thickness level, 1 or 2, in table 2. More specifically, the sheet thickness level is "1" when the sheet thickness T is equal to or less than 90 g/m$^2$ and "2" when the sheet thickness T is greater than 90 g/m$^2$. At S5, the CPU 3-1 stores the determined sheet thickness level in the memory.

At S6, using the reference codes obtained at S3 and S5, the CPU 3-1 generates the double-digit sheet classification code, a combination of one of the sheet classification codes "A" to "D" and either the thickness code "1" or "2", as described above. At S7, the CPU 3-1 retrieves the processing mode determination table corresponding to the double-digit sheet classification code.

More specifically, for example, when the double-digit sheet classification code generated at S6 is "A1", at S7 the CPU 3-1 selects the processing mode determination table for "A1". That is, table 3 is selected. At S8, the CPU 3-1 retrieves the selected processing mode determination table.

At S9, the CPU 3-1 obtains the quantity of sheets and the sheet size of the booklet to be processed and, at S10, determines the booklet processing mode, the spine formation (mode 1), the squeezing mode (mode 2), or the through mode (mode 3). In the present embodiment, according to table 3, the booklet processing mode is determined in accordance with the quantity of sheets divided into four levels: one to five sheets (level 1), six to ten sheets (level 2), 11 to 15 sheets (level 3), and 16 to 20 sheets (level 4), and the sheet width: not greater than 200 mm or greater than 200 mm. According to table 3, regardless of sheet size, when the quantity of sheets is within a range of 1 to 5, the through mode (mode 3) is selected. When the quantity of sheets is within a range of 6 to 10, the squeezing mode (mode 2) is selected. When the quantity of sheets is within a range of 11 to 20, the spine formation mode (mode 3) is selected. At S11, the booklet is processed in the selected mode. More specifically, the spine of the booklet is flattened in the mode 1. In the mode 2, the booklet is squeezed, but its spine is not flattened. In the mode 3, the bundle of sheets folded in two in the previous process is discharged as is. That is, the booklet is not squeezed and the spine is not flattened.

Similarly, in the case of coated sheets having a sheet thickness T greater than 90 g/m$^2$, the booklet processing mode is determined according to table 4 that is the processing mode determination table for the sheet classification code "B2". In the case of creased sheets having a sheet thickness T equal to or smaller than 90 g/m$^2$, the booklet processing mode is determined according to table 5 that is the processing mode determination table for the sheet classification code "D1". Then, the selected processing is performed.

It is to be noted that the user uses the CHANGE CRITERIA button 105*w*3 to change the criteria of the quantity of sheets, the sheet size, and the sheet thickness as well as classification of sheets in tables 3 to 5: the booklet processing determination tables.

As described above, the present embodiment can attain the following effects.

1) The pressing portion of the upper clamping member 325 of the clamping unit pressed against the booklet is not planar but is constructed of the multiple rollers having identical or similar cross-sectional shape. With such a configuration, in the final process in spine formation, the area of the upper clamping member 325 pressed via the booklet against the lower clamping member 326 can be reduced to one fifth to one tenth of that in the configuration in which the pressing portion of the upper clamping member 325 is planar. Typical clamping units squeeze the booklet for about 500 ms (squeezing time) and then release the booklet. In the present embodiment, the pressure rollers 325*b* are moved in the sheet width direction, perpendicular to the sheet conveyance direction, along the folded lines of the sheets, during the squeezing time. Accordingly, the spine of the booklet can be flattened over its entire width as the pressure rollers 325*b* move. Thus, the spine of the booklet can be flattened with one fifth to one tenth of the pressing force in the comparative configuration in a similar time period.

2) The force of the contact plate 330 to hold the folded leading-edge portion of the booklet can be reduced similarly. In other words, when the pressing portion of the upper clamping member 325 is constituted of the multiple pressure rollers 325*b*, the power required to flatten the spine can be reduced to one fifth to one tenth of that in the comparative configuration. Thus, the energy can be reduced.

3) Because the required pressing force (load) and the power for it can be reduced to one fifth to one tenth of that in the comparative configuration, the required strength of the components can be lower. Accordingly, the weight of the device and can be reduced. As a result, the present embodiment can attain resource saving in addition to reductions in the cost.

4) Because the upper clamping member 325 includes the multiple pressure rollers 325*b* and is in contact with the booklet SB at multiple points, the pressing force can be dispersed. Accordingly, the booklet can be prevented from wrinkling, and the appearance of the booklet can be improved.

5) Providing three options in the booklet processing, the present embodiment can suit needs of the users better. For example, the user may desire to reduce the thickness of the booklet but does not desire to make the spine flat by pressing the spine against the contact plate 330. The second option, mode 2, can respond to such a need. In the mode 2, before its folded leading-edge portion comes in contact with the contact plate 330, the booklet is stopped upstream from the contact plate 330 and then is squeezed. The pressure rollers 325*b* are moved in the width direction, thereby squeezing the folded portion of the booklet over the entire width of the booklet, after which the booklet is released from the auxiliary clamping plates 320 and 321 and the clamping members 325 and 326. Thus, although the effect may be lower than that attained in spine formation, the thickness (bulging) of the booklet can be reduced.

In other words, because the user can select whether to squeeze the booklet from the front cover side and the back cover side and flatten the spine or to squeeze the booklet without flattening the spine. Therefore, the user can process the booklet as desired.

Because suitable processing for good appearance of booklets can be preset in accordance with the quantity of sheets, the present embodiment can save resources. That is, the user can be prevented from making an improper selection of the processing. Accordingly, waste of sheet as well as power can be avoided.

It is to be noted that, although the pressure rollers 325*b* and the planar clamping member 326 are arranged vertically, the direction is not limited thereto as long as they face each other via the booklet in the direction perpendicular to the sheet conveyance direction. Further, the terms "vertical" and "perpendicular" used in this specification are not limited to exact vertical and perpendicular direction but include substantially vertical and perpendicular direction, respectively.

Numerous additional modifications and variations are possible in light of the above teachings. It is therefore to be understood that, within the scope of the appended claims, the disclosure of this patent specification may be practiced otherwise than as specifically described herein.

What is claimed is:

1. A spine formation device for forming a spine of a bundle of folded sheets, the spine formation device comprising:

a sheet conveyer to convey the bundle of folded sheets, with a folded portion of the bundle forming a front end portion of the bundle;

a clamping unit disposed downstream from the sheet conveyer in a sheet conveyance direction in which the bundle of folded sheets is transported, for squeezing the folded portion of the bundle in a direction of thickness of the bundle, the clamping unit including:

a pressure roller assembly including multiple pressure rollers arranged in a single line along the folded portion of the bundle, a planar clamping member disposed facing the multiple pressure rollers in a direction perpendicular to the sheet conveyance direction, to press the bundle against the multiple pressure rollers, and a unit to move the pressure roller assembly and the planar clamping member close to and away from each other;

a contact member disposed downstream from the clamping unit in the sheet conveyance direction and including a flat contact surface against which the folded portion of the bundle is pressed;

an elevation unit to move the contact member in the direction perpendicular to the sheet conveyance direction; and a controller operatively connected to the sheet conveyer, the clamping unit, and the elevation unit.

2. The spine formation device according to claim 1, wherein, in a downstream end portion of the clamping unit in the sheet conveyance direction, a facing side of each of the multiple pressure rollers, facing the planar clamping member, has a shape symmetrical to a facing side of the planar clamping member facing the multiple pressure rollers in a vertical cross section along long axes of the multiple pressure rollers.

3. The spine formation device according to claim 2, wherein, in the sheet conveyance direction, a downstream edge portion of the planar clamping member on the side facing the multiple pressure rollers is chamfered, a downstream edge portion of each of the multiple pressure rollers on the side facing the planar clamping member is chamfered, and a space defined by the contact member, the downstream edge portion of the planar clamping member, and the downstream edge portions of the multiple pressure rollers is tapered in the vertical cross section along the long axes of the multiple pressure rollers.

4. The spine formation device according to claim 1, further comprising a driving unit to move the multiple pressure rollers of the clamping unit along the folded portion of the bundle.

5. The spine formation device according to claim 4, wherein the driving unit moves the multiple pressure rollers a distance equal to or greater than half an interval between axes of adjacent pressure rollers.

6. The spine formation device according to claim 4, the clamping unit further comprises a base to support the multiple pressure rollers rotationally, and the driving unit moves the base, and the multiple pressure rollers are driven by the base.

7. The spine formation device according to claim 4, wherein the driving unit drives the multiple pressure rollers directly.

8. The spine formation device according to claim 1, further comprising a processing selector for selecting a processing mode in which the bundle is processed from a group of selectable processing modes including a spine formation mode in which the clamping unit squeezes the bundle with the folded portion of the bundle pressed against the contact member, a squeezing mode in which the clamping unit squeezes the bundle but the folded portion of the bundle is not pressed against the contact member, and a through mode in which the clamping unit does not squeezes the bundle, and the controller controls the sheet conveyer, the clamping unit, and the elevation unit in accordance with the selected processing mode.

9. The spine formation device according to claim 8, wherein the processing mode of the bundle is selected in accordance with a sheet-related variable comprising at least one of a quantity of the folded sheets, a sheet size, a sheet thickness, and a sheet type.

10. The spine formation device according to claim 9, further comprising a processing mode selection criteria changer for changing preset sheet-related variable criteria for selecting the processing mode of the bundle.

11. A bookbinding system comprising:

an image forming apparatus to form images on sheets of recording media;

a post-processing apparatus to fold a bundle of sheets transported from the image forming apparatus; and a spine formation device for forming a spine of the bundle of folded sheets, the spine formation device comprising:

a sheet conveyer to convey the bundle of folded sheets with a folded portion of the bundle forming a front end portion of the bundle;

a clamping unit disposed downstream from the sheet conveyer in a sheet conveyance direction in which the bundle of folded sheets is transported, for squeezing the folded portion of the bundle in a direction of thickness of the bundle, the clamping unit including:

a pressure roller assembly including multiple pressure rollers arranged in a single line along the folded portion of the bundle, a planar clamping member disposed facing the multiple pressure rollers in a direction perpendicular to the sheet conveyance direction, to press the bundle against the multiple pressure rollers, and a unit to move the pressure roller assembly and the planar clamping member close to and away from each other;

a contact member disposed downstream from the clamping unit in the sheet conveyance direction and including a flat contact surface against which the folded portion of the bundle is pressed;

an elevation unit to move the contact member in the direction perpendicular to the sheet conveyance direction; and a controller operatively connected to the sheet conveyer, the clamping unit, and the elevation unit.

12. The bookbinding system according to claim 11, further comprising a processing selector for selecting a processing mode in which the bundle is processed from a group of selectable processing modes including a spine formation mode in which the clamping unit squeezes the bundle with the folded portion of the bundle pressed against the contact member, a squeezing mode in which the clamping unit squeezes the bundle but the folded portion of the bundle is not pressed against the contact member, and a through mode in which the clamping unit does not squeezes the bundle, and the controller controls the sheet conveyer, the clamping unit, and the elevation unit in accordance with the selected processing mode.

13. The bookbinding system according to claim 12, wherein the processing mode of the bundle is selected in accordance with a sheet-related variable comprising at least one of a quantity of the folded sheets, a sheet size, a sheet thickness, and a sheet type.

14. The bookbinding system according to claim 13, wherein the spine formation device further comprises a processing mode selection criteria changer for changing preset sheet-related variable criteria for selecting the processing mode of the bundle.

* * * * *